US005639360A

United States Patent [19]

Prum et al.

[11] Patent Number: 5,639,360

[45] Date of Patent: Jun. 17, 1997

[54] ELECTRODE FOR AN ELECTROLYTIC CELL, USE THEREOF AND METHOD USING SAME

[75] Inventors: Norbert Prum, Genk, Belgium; Roland Schnettler, Schwerter Strasse 138,, D-5800 Hagen; Hans Josef May, Ulmen 17, D-5860 Iserlohn, both of Germany

[73] Assignees: Sikel N.V., Genk, Belgium; Hans Josef May, Iserlohn; Roland Schnettler, Hagen, both of Germany

[21] Appl. No.: 157,017

[22] PCT Filed: May 27, 1992

[86] PCT No.: PCT/BE92/00022

§ 371 Date: Feb. 23, 1994

§ 102(e) Date: Feb. 23, 1994

[87] PCT Pub. No.: WO92/21794

PCT Pub. Date: Dec. 10, 1992

[30] Foreign Application Priority Data

May 30, 1991 [WO] WIPO ..... PCT/BE91/00033
Jul. 8, 1991 [DE] Germany ..... 41 22 543.0

[51] Int. Cl.[6] ..... C25D 3/00; C25D 3/20; C25D 17/10; C25D 17/16

[52] U.S. Cl. ..... 205/138; 205/101; 205/270; 205/316; 205/261; 204/232; 204/237; 204/263; 204/266

[58] Field of Search ..... 204/232, 239, 204/263, 266; 205/270, 316, 101, 138

[56] References Cited

U.S. PATENT DOCUMENTS

| | | | |
|---|---|---|---|
| Re. 34,191 | 3/1993 | Brown | 205/96 |
| 4,138,295 | 2/1979 | DeNora et al. | 204/98 |
| 4,197,179 | 4/1980 | Ezzel et al. | 204/255 |
| 4,578,158 | 3/1986 | Kanamare et al. | 204/44.2 |
| 4,675,254 | 6/1987 | Shuster et al. | 429/51 |
| 4,770,756 | 9/1988 | Caulfield et al. | 204/263 |
| 4,772,362 | 9/1988 | Martin et al. | 204/44.2 |
| 5,084,145 | 1/1992 | Suzaki et al. | 205/141 |
| 5,290,410 | 3/1994 | Tenfält et al. | 204/98 |

FOREIGN PATENT DOCUMENTS

| | | |
|---|---|---|
| 0050373 | 4/1982 | European Pat. Off. . |
| 0052332 | 5/1982 | European Pat. Off. . |
| 0412600 | 2/1991 | European Pat. Off. . |
| 890015 | of 0000 | France . |
| 144427 | 10/1980 | Germany . |

OTHER PUBLICATIONS

Patent Abstracts of Japan, vol. 8, No. 11 (C–205) (1448) 18 Jan. 1984, JP. 58177489.

Patent Abstracts of Japan, vol. 14, No. 555 (C–78) 10 Dec. 1990 JP 2236297.

Patent Abstracts of Japan, vol. 7, No. 191 (C–182) (1336) 20 Aug. 1983–JP 58093893.

Patent Abstracts of Japan, vol. 8, No. 187 (C–240) (1624) 28 Aug. 1984–JP 59 080791.

Patent Abstracts of Japan, vol. 12, No. 405 (C–539) (3252) 26 Oct. 1988–JP 63 145800.

*Primary Examiner*—Kathryn L. Gorgos

*Attorney, Agent, or Firm*—Sughrue, Mion, Zinn, Macpeak & Seas

[57] ABSTRACT

The present invention relates to an electrode preferably an insoluble electrode for an electrolytic cell. The electrode is located within an enclosure defining a chamber, a wall of said enclosure being formed by a membrane allowing ions to pass therethrough. The enclosure has an opening for feeding electrolyte, an opening for evacuating electrolyte and means conducting the upward current of electrolyte with a velocity in the vicinity of the electrode of at least 0.01 m/s. The invention relates also to plants and processes using such electrode for the plating or deplating of metal strips.

25 Claims, 13 Drawing Sheets

ELECTRODE FOR AN ELECTROLYTIC CELL, USE THEREOF AND METHOD USING SAME

FIELD OF THE INVENTION

This is a national stage application of PCT/8392/00022 filed May 27, 1992.

The present invention relates to an electrode, preferably an insoluble electrode for an electrolytic cell. The invention relates also to plants and processes using such electrode for the plating or deplating of metal strips.

BACKGROUND OF THE INVENTION

Insoluble electrodes are commonly employed in processes for coating strips of metals by electrochemical routes, preferably of zinc-coated or galvanized steel strips, with the aid of metals or metal alloys, in accordance with which an electrolyte laden with salts of the coating metals is recycled between the cathodic metal strip to be coated and the insoluble anode.

Depending on the electrolyte used, for example sulphate- or chloride-based electrolytes, the use of this process generates gases at the anode, for example oxygen or chlorine, which partially undergo undesirable bonding with the coating metals or which, because of their high reactivity or their toxicity, have detrimental consequences during the use of the coating process or for the environment. These gases which arise at the anode mix with the electrolyte and can, consequently, cause undesired reactions and enter the environment, given that during the electrolytic coating of metal strips the electrolyte circuit on the strip cannot be separated from the atmosphere.

A process for coating galvanized steel strips with the aid of iron compounds or of alloys of the latter is known. To do this, a sulphate-based electrolyte laden with salts of coating metal is conducted in a closed circuit between the steel strip to be coated circulating endlessly and the insoluble anodes. Because of known electrochemical processes, iron precipitates in the form of iron compounds at the cathodic metal strip. Divalent oxygen is released at the anode, oxygen which comes into contact with the metal salts, more particularly because of the recycling of the electrolyte. This oxygen oxidizes a part of the divalent iron to trivalent iron, with the result that large quantities of iron oxide are produced, which soil the electrolytes and which must be separated from the circuit by making use of costly filtration processes.

Furthermore, the formation of $Fe^{3+}$ reduces the cathodic efficiency of the current and deteriorates the adhesion of the deposited layer.

Finally, the use of salts of the coating metal, or the use of iron in corresponding dissolving plants and the replacement of other substances employed which are entrained together increase the cost of such a coating process very appreciably.

BRIEF DESCRIPTION OF THE INVENTION

To solve these problems, the applicants have developed a special electrode which is particularly useful in processes for electrochemical coating of metal strips, but which is also suitable in other processes such as processes for electrochemically removing a coating from a strip such as a steel strip.

The electrode according to the invention is placed in an enclosure defining a chamber and one wall of which is formed by a membrane allowing ions to pass through the latter, the said enclosure having a first opening for feeding the chamber with an electrolyte and a second opening for removing the electrolyte from the chamber.

The enclosure or the electrode is advantageously provided with means intended to ensure a minimum velocity of the electrolyte in the vicinity of the electrode, a velocity which is preferably higher than 0.1 m/s, in particular higher than 0.5 m/s.

Such means are, for example, baffles or fins directing the flow of electrolyte in the chamber or a part thereof.

In one embodiment, the baffles or fins extend from the vicinity of the first opening of the enclosure as far as the vicinity of the second opening of the enclosure, so as advantageously to divide the chamber into a number of separate compartments extending between the electrode and one wall of the chamber or enclosure, in particular the membrane.

In another embodiment, the said baffles or fins create an at least partially upward current of electrolyte in the vicinity of the electrode. According to a special feature of this embodiment, the baffles or fins extend in a substantially vertical direction from the vicinity of the lower part of the enclosure as far as the vicinity of the upper part of the enclosure, so as to define channels conducting the electrolyte into the upper part of the enclosure; this part having an opening for drawing gases out of the chamber and an opening for discharging the electrolyte.

The baffles or fins advantageously extend at least from one edge of the electrode as far as the opposite edge of the latter.

The membrane is preferably an anionic or anion exchange membrane or a cationic or cation exchange membrane. On the outer side of the enclosure, it is advantageously provided with a protective layer or web made, for example, of synthetic material (polymer, polyester, etc.) advantageously reinforced with fibres (glass).

A porous support preferably extends in the vicinity of the membrane and is used to support at least a part of the latter. Such a support is, for example, a perforated component, a porous web or a trellis advantageously made of Zr, Ti or of stainless steel.

In one embodiment, the support has a layer acting as an electrode on the face opposite that adjacent to the membrane, whereas according to another embodiment, the membrane rests on a support acting as an electrode, the said support being provided with an insulating layer on its face adjacent to the membrane.

The membrane of an electrode according to the invention advantageously has a thickness of between 50 and 150μ. In the case of an anionic membrane, it preferably has a multilayer structure where at least one layer is obtained by grafting an amino monomer or a precursor of an amino compound onto a polymer substrate and by cross-linking.

Another subject of the present invention is the use of an electrode according to the invention in an electrolytic cell.

Finally, another of its subjects is a process for electrochemical coating of galvanized steel strips by means of metals or metal alloy. In this process, an electrolyte laden with salts of the coating metals is recycled in a known manner between the metal strip to be coated (cathode) and the insoluble anode. According to the process, in accordance with the invention, an electrode in accordance with the invention is employed as insoluble anode. The membrane is arranged between the anode and the metal strip to be coated so as to form a separation between a cathodic space adjacent to the strip and the anode chamber defined by the anode enclosure. In the process, in accordance with the invention, a first primary electrolyte circuit is created in the chamber and a second secondary electrolyte circuit in the cathodic space, the membrane preventing the transfer of gases generated at the anode into the second electrolyte circuit and the transfer of salts of the coating metals from the cathodic space towards the first electrolyte circuit. In this case the gases remain in the electrolyte circuit which is maintained separately in the anodic space and can be regularly removed. The electrolyte of the anodic circuit is not laden with the coating metals. The gas which is always formed can be removed from this circuit in a relatively simple manner. The two circuits are obviously separated from one another, with the result that mixtures cannot form.

By using the electrode according to the invention, processes have been proposed in accordance with the invention for coating metal strips, preferably galvanized steel strips with the aid of iron, or of iron compounds or of alloy containing iron. Depending on the nature of the electrolyte employed in the cathodic space or vessel, it is proposed to use, as diaphragms, cation exchange membranes or anion exchange membranes which are known per se. What is known as bipolar membranes can also be used with a corresponding modification or adaptation of the electrolytes.

If an anion exchange membrane of suitable nature is arranged between the anode and the metal strip to be coated, when a sulphuric electrolyte enriched in iron and zinc sulphate is employed in the cathodic space, then only the transfer of $SO_4^{--}$ ions into the anode chamber is ensured as charge transport and the transfer of the salts of coating metals is prevented. The electrolyte devoid of metal and composed of water and sulphuric acid in the anode chamber is here enriched in sulphuric acid. The oxygen which forms at the insoluble anode can be removed from the anode chamber. The transfer of oxygen into the cathodic space is prevented by the corresponding anion exchange membrane.

When a cation exchange membrane is employed for the plating of metal strips with iron, compounds or alloys containing iron and when a sulphuric electrolyte is employed in the cathodic space, the charge transport takes place by the transfer of hydrogen ions from the anode chamber into the cathodic space. The oxygen which forms at the anode is removed from the sulphuric electrolyte devoid of iron from the anodic circuit. The transfer of oxygen into the cathodic space is also prevented by this cation exchange membrane.

When a chloride-containing electrolyte enriched in iron or zinc chloride is employed in the cathodic space, it is also possible, in accordance with the present invention, to employ appropriate anion exchange membranes. When this process is used, chlorine ions are allowed to enter the anode chamber as charge carriers. However, the transfer of metal salts into the anodic space is prevented. The electrolyte, which is composed of water and hydrochloric acid in the anode chamber is enriched in chlorine ions released in the form of gas at the anode and is advantageously removed in a controlled manner with the electrolyte circuit from the anode chamber. A transfer of chlorine into the cathodic space is prevented by the appropriate exchange membrane.

When a chloride-containing electrolyte is employed in the cathodic space, it is also possible to employ cation exchange membranes of suitable type. In this case, too, the transfer of acids and salts from the cathodic space into the anodic space is again prevented. The charge transport takes place by the transfer of hydrogen ions from the anodic space or chamber into the cathodic space. The gases separated at the anode are removed. A transfer of the separated gases into the cathodic space is prevented by the cation exchange membrane.

By virtue of this process, in accordance with the present invention for coating metal strips with iron, the formation of trivalent iron and of iron oxide, which forms iron sludge in the electrolyte when the known process is used, is completely prevented, since this sludge results from an oxidation due to the oxygen released at the anode.

Given that the action of atmospheric oxygen in the cathodic circuit cannot be completely prevented during the coating with iron performed in accordance with the present invention, a certain quantity of trivalent iron is still also formed in the cathodic circuit. This trivalent iron soils the cathodic circuit, with the result that this electrolyte must also still be filtered. In accordance with the present invention, it is consequently proposed to feed the circuit with cathodic electrolyte, with a view to replacing the iron removed during the coating, with a corresponding proportion of iron feed, for example in an intermediate dissolving station. The necessary proportion of added elemental iron suffices, because of the excess, to reduce the trivalent iron to divalent iron, with the result that iron oxide sludge is no longer formed in the cathodic electrolyte circuit.

The sulphuric acid which is enriched in excess during the use of a sulphuric electrolyte in the cathodic circuit and during the use of an anion exchange membrane in the anodic circuit, is employed in the dissolving station and is thus returned into the cathodic circuit, where the rate of dissolving of the iron and of the other coating metals, for example zinc, is considerably accelerated.

The gaseous chlorine which is formed at the anode during the use of a chloride-containing electrolyte in the cathodic circuit and of an anion exchange membrane is removed by suction from the anodic circuit and is burnt to hydrochloric acid by the gaseous hydrogen formed in the dissolving station and is used to accelerate the dissolving of the metals and is consequently returned into the cathodic circuit via the dissolving station.

Another subject of the present invention is a process for removing a layer of metals or of a metal which is present on a metal strip such as a steel strip. This layer of metals or metal is, for example, a layer deposited electrolytically, such as a protective layer of Zn or Zn alloy. By way of particular example, the Zn or Zn alloy layer deposited as a protective layer on a face or strip has a thickness of between 0.1 and 2 microns (preferably less than 1 micron). Such a layer is preferably obtained by subjecting the strip to an electrolytic treatment in a bath containing from 15 to 100 g/l, advantageously from 30 to 80 g/l of Zn. The current density in the cells is, for example, between 20 and 200 $A/dm^2$, but is preferably between 40 and 150 $A/dm^2$. The electrode in accordance with the invention can be advantageously employed for this deposition.

During this deposition, the strip and optionally the electrolyte in the said cells are set in motion in the cells. The relative velocity of the strip in relation to the electrolyte is advantageously between 1 and 8 m/s, preferably between 3 and 5 m/s.

In the process, in accordance with the invention, for removing a layer of a metal or of metal alloy from a strip, an electrolyte is recycled between the strip acting as the anode and an insoluble cathode; an advantageously anionic membrane being arranged between the strip and the cathode, so as to form a separation between a cathodic space and an anodic space adjacent to the strip.

This membrane makes it possible to overcome the formation of a deposit (black in the case of Zn and of Ni) on the cathode by the metals redissolved in the electrolyte, such as, for example Zn and/or Ni; this deposit reducing not only the efficiency of the cathode but, above all, the lifetime or the service life of the latter.

This membrane may be a porous web (pores of a few microns, 1 to 50μ), but is preferably an anionic membrane, that is to say, a membrane which does not permit, or which limits, the passage of cations (such as $Zn^{++}$, $Ni^{++}$, $Fe^{++}$) through the latter.

In the case where an acidic electrolyte is employed, it has been noticed that a release of hydrogen is present at the surface of the cathode. To avoid hydrogen bubbles combining to form large bubbles, it has been noticed that it is useful to employ the membrane as the wall of a chamber adjacent to the cathode and to maintain a so-called secondary electrolyte stream or flow in the said chamber.

The velocity of the electrolyte in the chamber is, for example, higher than 0.1 m/s, but is preferably lower than 1.5 m/s, to ensure that the hydrogen bubbles do not combine to form large bubbles.

The electrolyte circulating in the chamber adjacent to the cathode, called secondary electrolyte hereinafter, preferably has a composition differing from the primary electrolyte; that is to say, the electrolyte in contact with the strip. The secondary electrolyte is advantageously an electrolyte containing no Zn or Ni, but containing from 50 to 100 g/1 of $Na_2SO_4$ and whose pH is preferably adjusted to a value of 1.5 to 2.

The upper part of the chamber is also preferably subjected to a gas suction. For example, a vacuum is created in the upper part of the chamber such that the pressure in the chamber is lower than 0.75×atmospheric pressure.

The primary electrolyte employed in the deplating cell may, for example, be an electrolyte containing less than 50 g/l of free acid, advantageously less than 5 g/l, preferably approximately 1 g/l of free acid (for example free $SO_4^{=}$). The pH of the electrolyte is advantageously from 1.5 to 2.

The current density employed in the "deplating" cell (cell for removing a metallized layer) in which the cathode is placed in a chamber is advantageously lower than 60 A/dm$^2$, but is preferably between 15 and 30 A/dm$^2$ in the case of an acidic electrolyte.

The temperature of the primary and secondary electrolyte is advantageously between 20° and 60° C., preferably between 40° and 60° C.

Other special features and details of the invention will emerge from the following detailed description, in which reference is made to the drawings appended hereto.

DESCRIPTION OF THE PREFERRED EMBODIMENTS OF THE INVENTION

Figure 1:
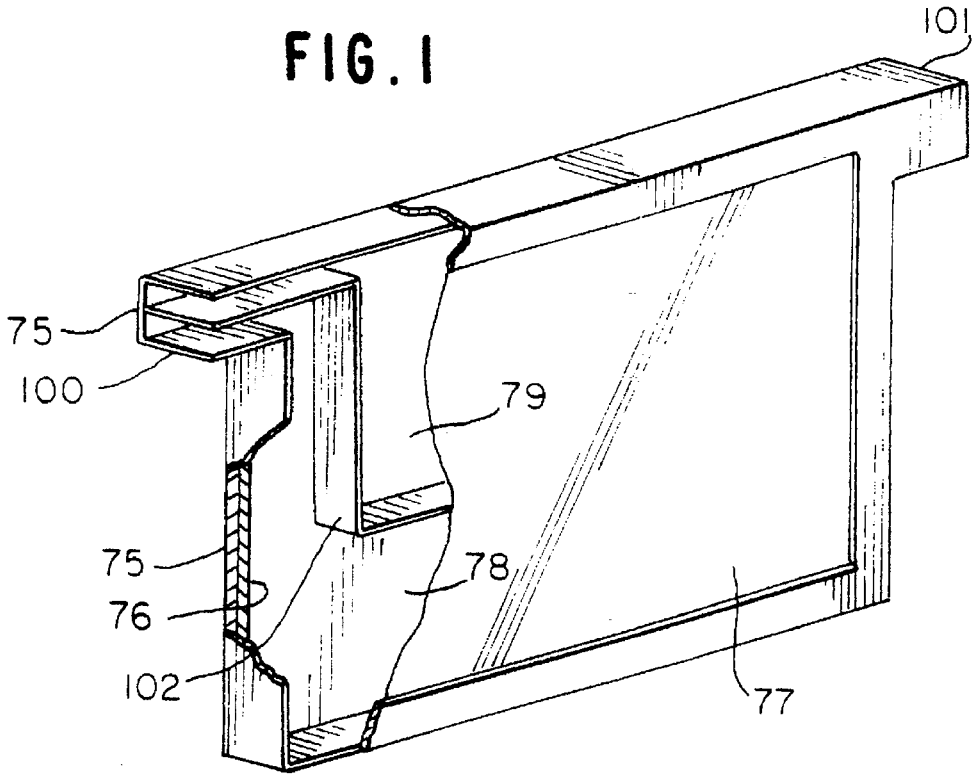
FIGS. 1 to 5 show various embodiments of electrodes in accordance with the invention.

FIG. 1 shows in perspective an electrode in accordance with the invention, which is advantageously employed in a "deplating" cell, but which can also be employed for the deposition of Zn, Zn—Ni, Zn—Fe or another Zn alloy.

This electrode comprises a support 75 carrying a plate 76 intended to form the anode or the cathode. The support 75 forms an enclosure which has a window in which a membrane 77 is placed.

The membrane 77 forms a wall of the enclosure which defines a chamber 78, 79. This membrane allows ions such as anions or cations to pass through.

The enclosure has a first opening 100 for feeding the chambers 78, 79 with electrolyte and a second opening 101 for discharging electrolyte from the chambers 78, 79.

To ensure a minimum velocity of the electrolyte in the vicinity of the electrode 76 for removing gases (such as oxygen when the electrode works as an anode, or hydrogen when the electrode works as a cathode in a "deplating cell" deplating process) formed in the vicinity of the electrode, the enclosure is provided with a guiding wall or fin 102 extending between the said first and second openings, so as to divide the enclosure into two compartments 78, 79 which are adjacent but separated from one another. The fin 102 extends between the electrode 76 and the wall of the enclosure provided with the membrane.

By virtue of this fin 102, it has been possible to ensure an electrolyte velocity of at least 0.04 m/s in the compartments 78, 79 in the vicinity of all points of the electrode or plate 76. In the case shown in FIG. 1, the electrolyte was delivered to the compartments 78, 79 with a velocity of the order of 0.5 m/s. The electrode 76-membrane 77 distance was 0.5 cm.

Figure 2:
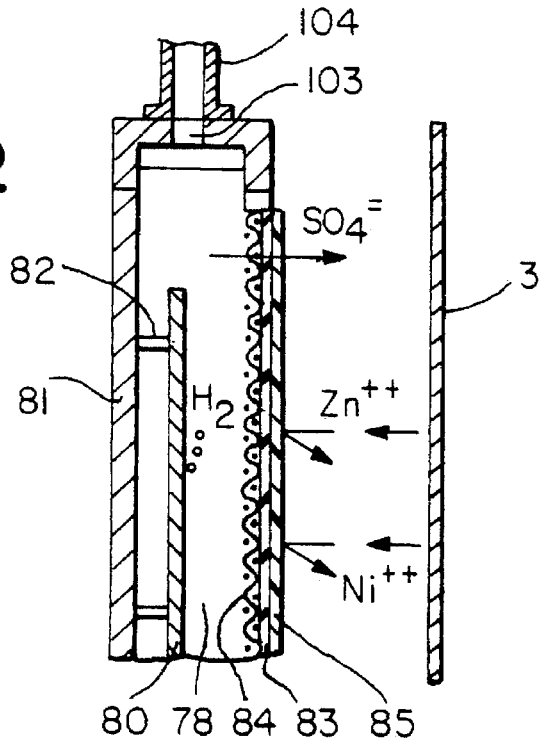

FIG. 2 shows in section another embodiment of an electrode in accordance with the invention.

The electrode 80, made of titanium but provided with an active layer, is integrally attached to a support 81 by means of arms 82.

The support 81 forms with a membrane 83 an enclosure surrounding the electrode 80. This membrane 83 is secured to a grid or trellis 84 made of titanium and is provided on its face opposite that adjacent to the electrode with a porous film 85 protecting the membrane. This film is resistant to acids and is reinforced with fibers. This film is, for example, a polyester film.

When such an electrode is employed in a "deplating" cell, the membrane is anionic. Such a membrane is, for example, of multilayer structure, each of the layers consisting of a membrane obtained by the process described in FR-8900115 (Application No.). A membrane of this type is prepared by grafting an amino compound onto a polymer substrate (ethylene-co-poly-tetrafluoroethylene film) and by crosslinking the latter.

During an operation of removal of undesired Ni deposited on the first layer of Zn, $Zn^{++}$ and $Ni^{++}$ ions leave the face of the strip facing the cathode. These cations cannot pass through the anionic membrane, with the result that a rapid deposition of Zn, Ni on the cathode is avoided. This makes it possible to increase the lifetime or the service life of the electrode.

Hydrogen is released in the vicinity of the cathode in the enclosure formed by the support and the membrane, while $SO_4^=$ anions pass through the membrane to leave the enclosure.

To remove the gas formed in the enclosure (hydrogen in the electrode of the "deplating" cell as described above), the latter has an opening 103. This opening 103 advantageously permits a communication of the chamber 78 with a conduit 104 in which a suction system (vacuum pump, fan or the like), not shown, is fitted.

To avoid the formation of large bubbles of gas (hydrogen) which interfere with correct functioning of the electrode, the enclosure is connected to a device for circulating electrolyte in the enclosure and to a system for removing the gases; in particular, a system producing a vacuum in the upper part of the chamber, this vacuum being advantageously such that the pressure in the upper part of the chamber is lower than 0.75×the atmospheric pressure.

The velocity of the electrolyte in the chamber was higher than 0.1 m/s, but is nevertheless preferably lower than 1.5 m/s. Such a velocity makes it possible to ensure that the gas bubbles (hydrogen in the present case) do not combine to form large bubbles perturbing a correct functioning of the electrode.

Figure 6:
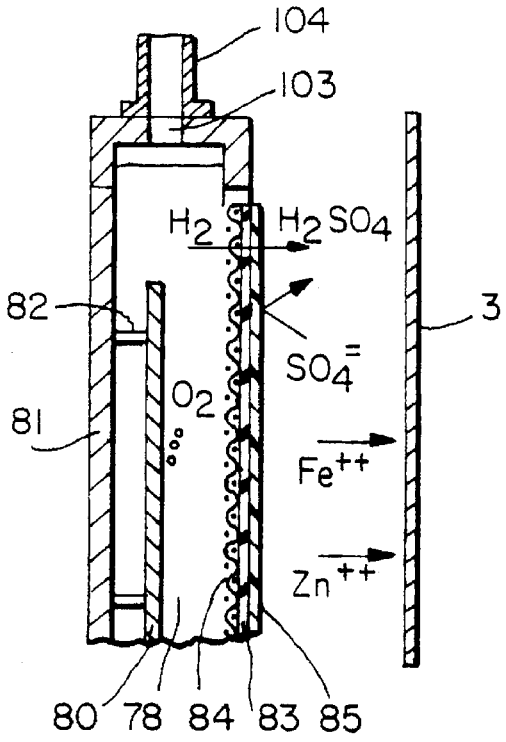
FIGS. 6 and 7 show electrodes similar to those shown in FIG. 2, but employed in an electro-deposition cell.
Figure 7:
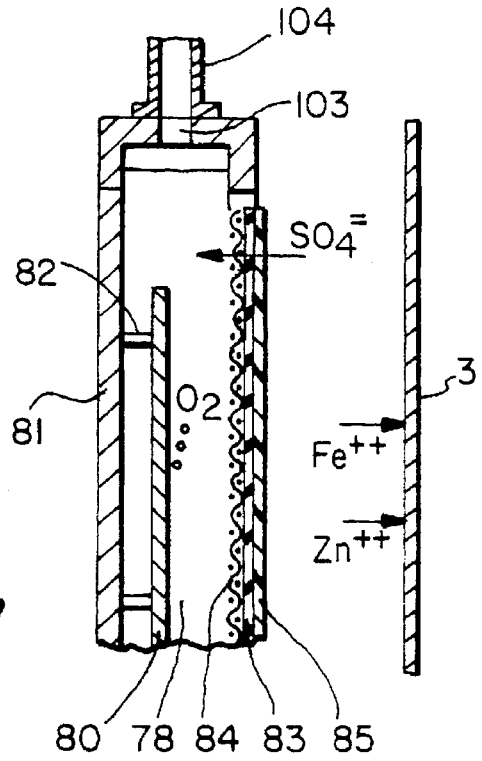
Figure 8:
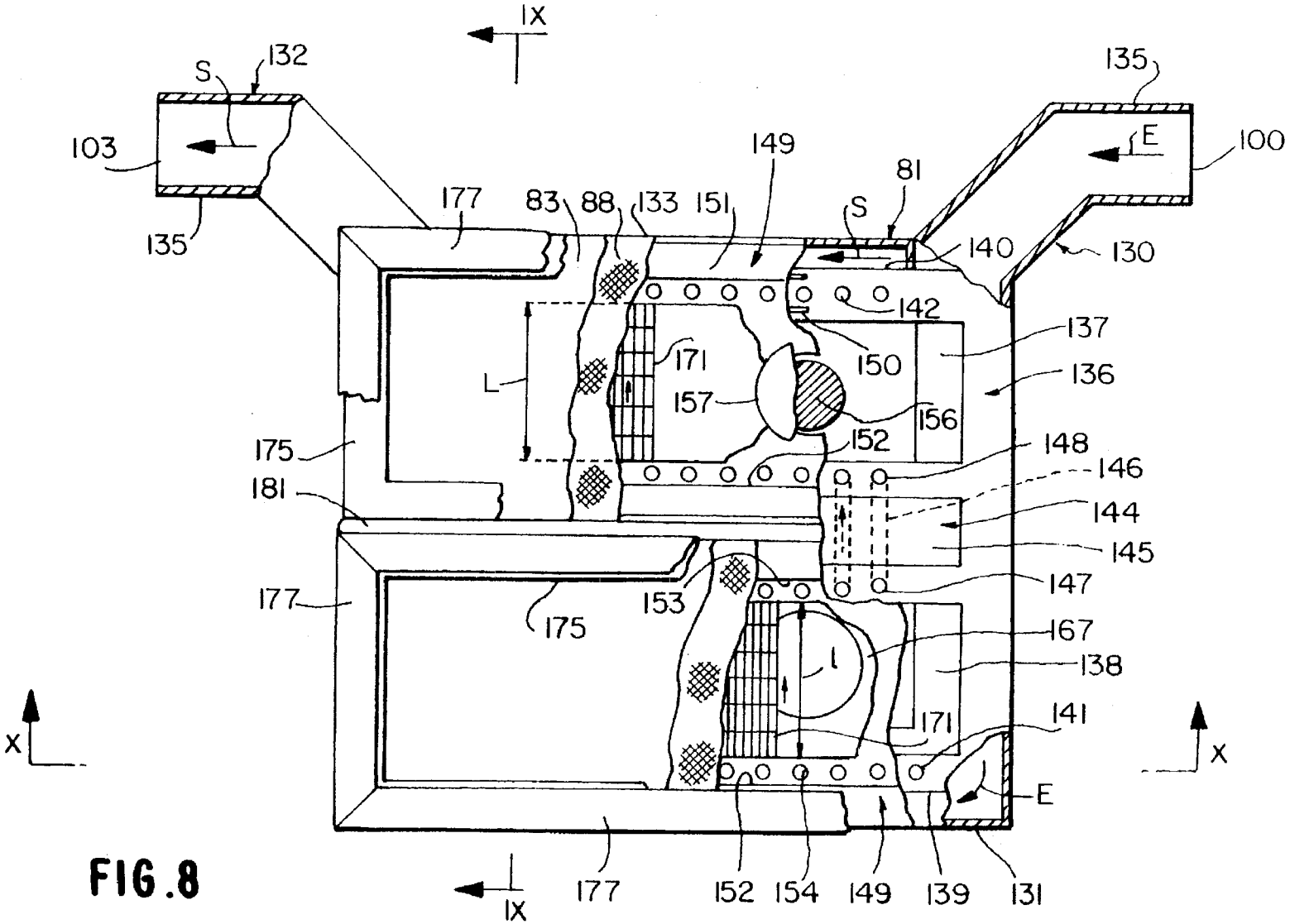
FIG. 8 is an elevation view with partial cutaway of a preferred embodiment of an electrode in accordance with the invention.
Figure 9:
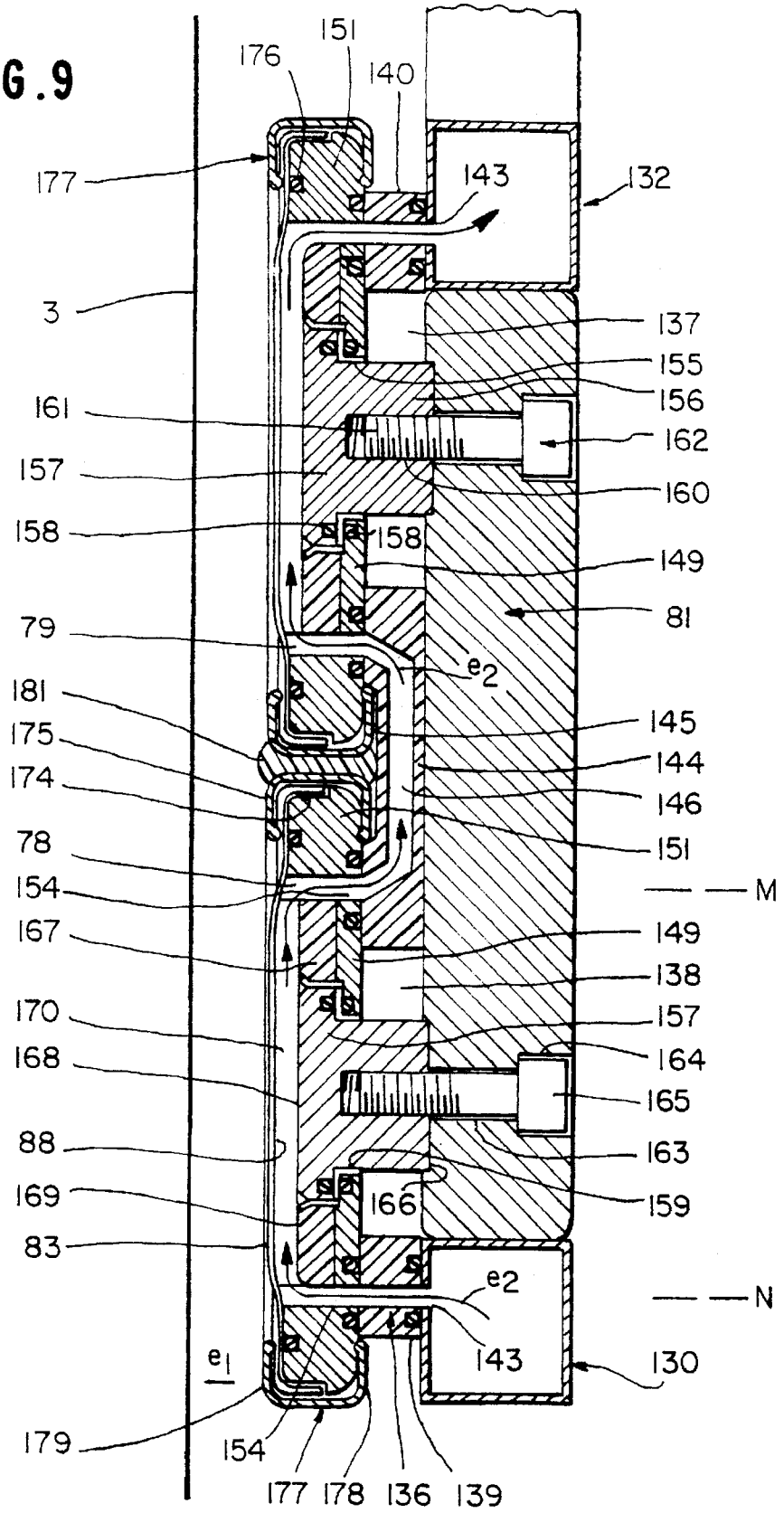
FIGS. 9 and 10 are views in section along the lines IX—IX and X—X of the electrode shown in FIG. 8.
Figure 10:
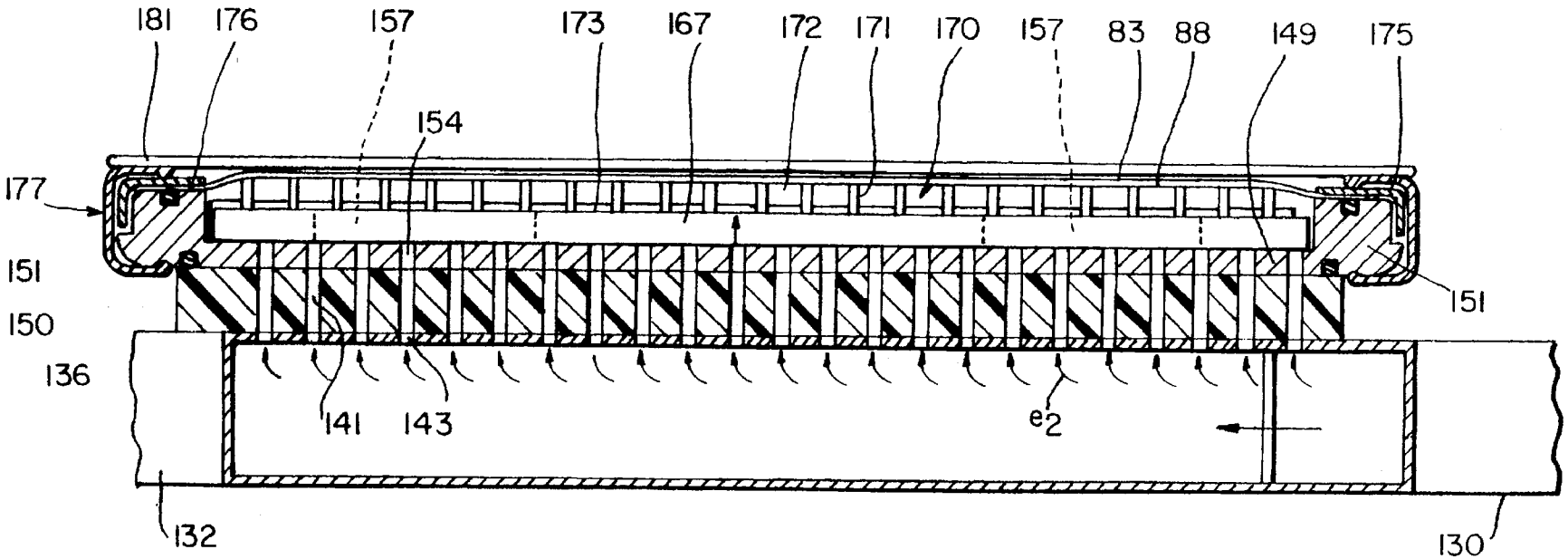

FIGS. 6 and 7 show an electrode similar to that shown in FIG. 2. It is employed as a cathode for depositing Zn and Fe electrolytically on the steel strip.

In the case of FIG. 6, the membrane 83 is a cationic membrane, with the result that the $SO_4^-$ anions formed in the vicinity of the strip 3 remain in the primary electrolyte, while iron and zinc are deposited on the strip. Oxygen (oxygen produced by the decomposition of water) is released at the cathode 80 and is removed by the conduit 104.

In the case of FIG. 7, the membrane 83 is an anionic membrane allowing the $SO_4^=$ anions formed in the vicinity of the strip 3 to pass towards the cathode 80. The oxygen released at the cathode is removed by the conduit 104.

Figure 3:
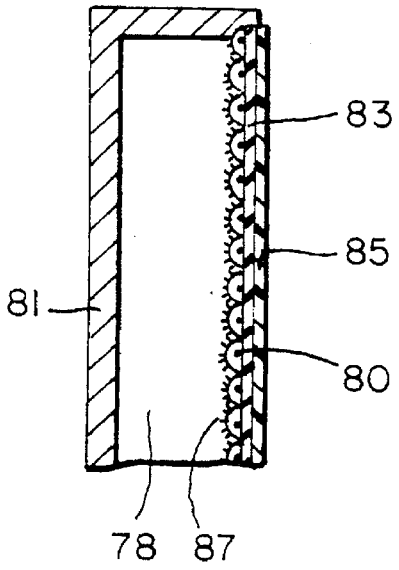

In FIG. 3, the enclosure surrounding the electrode 80 is still formed by a support 81 and a membrane 83. The electrode consists of a trellis or perforated plate made of titanium or zirconium, provided with an active layer 87 on the face facing the chamber 78 defined by the enclosure.

The membrane 83 is carried by the trellis and is coated with a protective porous layer 85.

Figure 4:
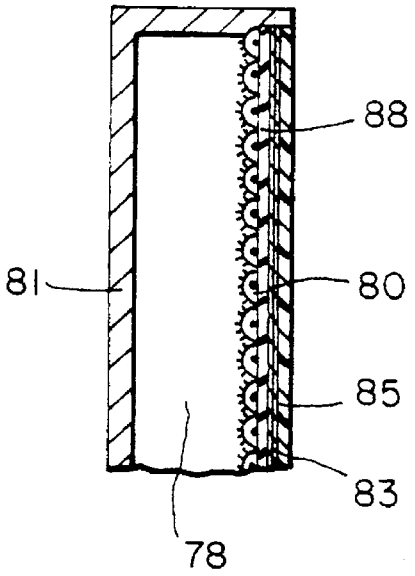
Figure 5:
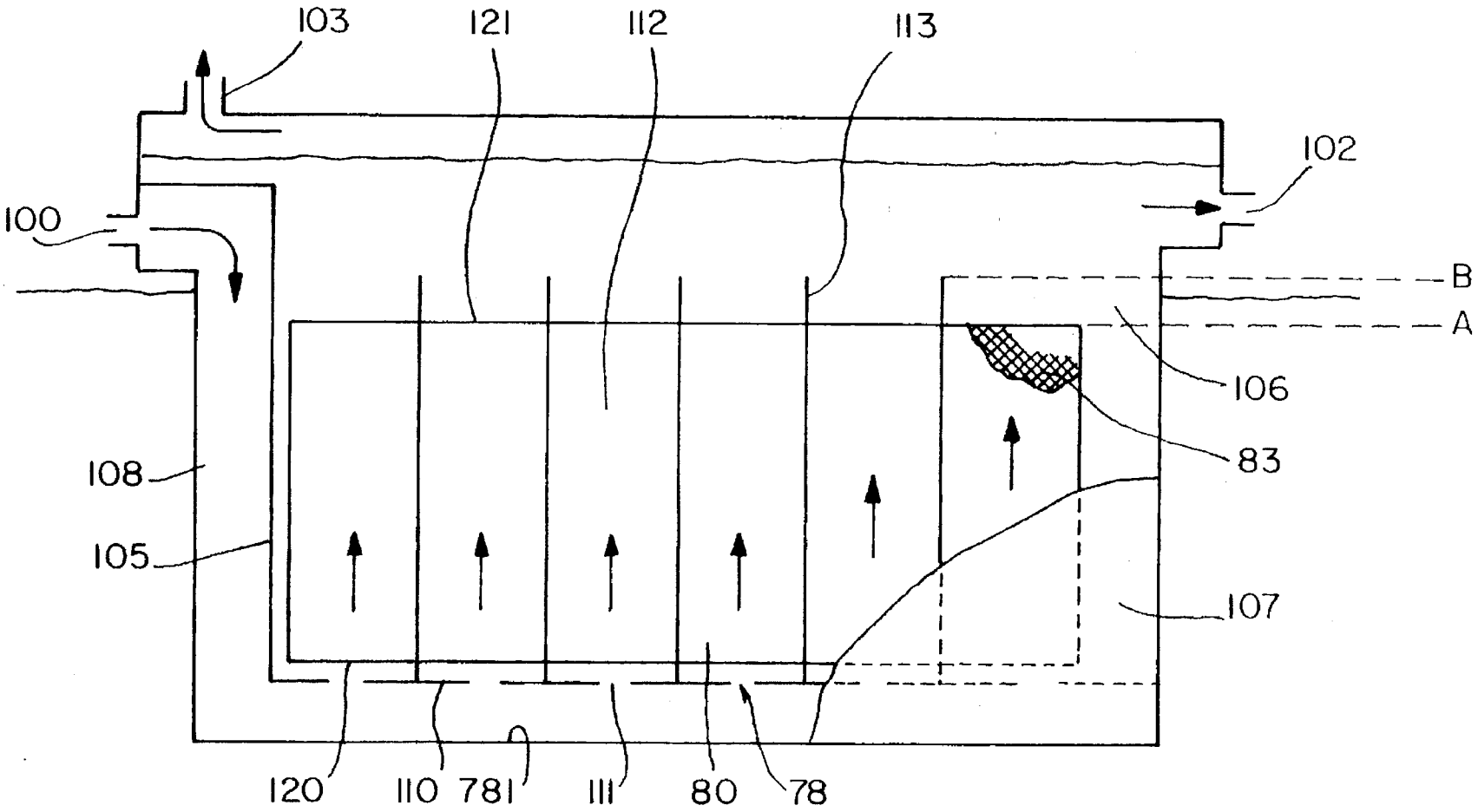

The electrode shown in FIG. 4 is similar to that shown in FIG. 5 except that an insulating porous web 88 is placed between the trellis and the membrane.

FIG. 5 shows in section another embodiment of an electrode in accordance with the invention.

This electrode 80 is adjacent to the membrane 83 which closes off the window of the enclosure. This enclosure defines a lower chamber 78 and has an opening or passage 100 for delivering electrolyte into the chamber 78, an opening or passage 101 for discharging electrolyte out of the chamber 78 and an opening 103 for discharging gases formed in the chamber, in particular in the vicinity of the electrode 80. These openings are situated at a level above the electrode 80 and the membrane 83.

A fin 105 extends between two opposed walls of the enclosure (front wall 106 provided with the membrane 80 and rear wall 107) so as to define a channel 108 for delivering the electrolyte entering the chamber 78 through the passage 100 in the vicinity of the bottom 781 of the chamber. This channel 108 is extended by a distribution chamber 109 adjacent to the bottom 781. This distribution chamber 109 has a wall 110 which has a series of orifices 111 for distributing the electrolyte into a series of channels 112 defined between the vertical fins 113. These fins 113 extend from the vicinity of the bottom 781 of the chamber or more precisely from the wall 110 as far as the vicinity of the upper part or more precisely up to a level B which is higher than but adjacent to the upper level A of the membrane 83 and of the electrode 80. The fins 113 which therefore extend between at least two opposed edges 120–121 of the electrode ensure an upward movement of the electrolyte along the electrode 80, such a movement (from the lower edge 120 towards the upper edge 121) promoting the removal of gas particles out of the electrolyte towards the upper part of the chamber which is advantageously subjected to a pressure reduction (suction of gas through the passage or opening 103).

In the direction of their width, the fins extend from the electrode 80 as far as the rear wall 107 of the enclosure so as to define separate channels 112 extending from the electrolyte distribution or division chamber 109 as far as the upper part of the enclosure.

FIG. 6 is a partially cutaway front view of an embodiment of an electrode in accordance with the invention.

This electrode comprises a support 81 which has an electrolyte channel 130 towards the lower part 131 of the electrode (arrow E) and an electrolyte discharge channel 132 (arrow S) in the upper part 133 of the electrode. The ends 135 of these channels 130, 132 form lugs used as means of securing and placing the electrode in an electrolytic cell. The support 81 is made of a material which is insoluble in the electrolyte or is covered with a protective layer which is insoluble in the electrolyte.

This support 81 is, for example, made of titanium.

A first frame which has two windows 137, 138 is applied against the support 81. This frame 136 has grooves in which seals made of synthetic material are housed. This frame 136 is made, for example, of an insulating synthetic material which is resistant to the electrolyte.

Along its lower 139 and upper 140 edges, the frame has a series of channels 141, 142 extending between the face of the frame which is applied against the support 81 and the face opposite the said face applied against the support 81, so that the said channels 141, 142 communicate with the delivery conduit 130 and with the discharge conduit 132 respectively, via orifices 153 with which the said conduits 130, 132 are provided.

The windows 137, 138 are separated from one another by a cross member 144 which has a dish 145 on the face opposite that facing the support 81. Channels or passages 146 are hollowed out in the said cross member 144 so as to extend between an opening 147 adjacent to one edge of the cross member 144 and an opening 148 adjacent to the opposite edge of the said cross member 144, the said openings 147, 148 being situated on the face of the cross member opposite that facing the support 81.

Two titanium plates 149 are applied against this frame 136, with interposition of leakproofing seals 150 housed in grooves with which the said plates are provided. Along their edges these plates are provided with a protuberance 151 forming a kind of basin. These plates 149 are perforated along the protuberance in the vicinity of the lower and upper edges 152, 153 so as to form channels 154 situated in the extension of the channels 141 and the openings 147, 148 of the frame 136.

Each plate 149 also has two holes 155 intended to provide a passage for a cylindrical member 156 made of titanium or of another material which is electrically conductive but resistant to the electrolyte. This cylindrical member is provided with a head 157 one wall of which is intended to bear against the plate 136 with interposition of circular seals 158 housed in the grooves of the member 156 or more precisely of the head 157 and of the plate 149 and of a seal 159 forming a sleeve partially covering the cylindrical member 156 and the face of the head 157 facing the plate 149.

In the vicinity of its end opposite that carrying the head 157, the cylindrical member 156 has a tapped hole 160 intended to work with the threaded shank 161 of a bolt 162. For each bolt, the support 81 has an orifice 163 intended to provide a passage for the shank 161. One end of the orifice 163 opens into a cavity 164 intended to receive the head 165 of the bolt 162, while the other end of the orifice opens into a hollow 166 with which the support 81 is provided, the said hollow being used for the correct placing of the cylindrical member in relation to the support 81.

When the bolt 162 is tightened, the cylindrical member 156 is pressed against the support 81 so as to ensure leakproofing between the support 81, the frame 136, the plate 149 and the head 157 of the member 156.

The plate 149 carries a layer 167 made of synthetic material which is electrically insulating and whose thickness is such that the face 168 of the free end of the head 157 and the face 169 of the layer 167 opposite that bearing on the plate 149 both lie substantially in the same plane. The latter corresponds to the plane along which the titanium electrode 170 lies. By virtue of the insulating layer 167 and the insulating sleeve 159 it is possible to ensure the insulation of the plate 149 in relation to the current delivered through the bolt 162 and the cylindrical member 156 to the electrode 170.

This electrode 170 consists of a series of vertical titanium strips 171 joined together by rods or other electrically conductive carrier (plate) members 173. These strips are advantageously parallel to one another. However, these strips could have been slightly inclined in relation to one another. In this case, the lengthwise edges (172) of the strips advantageously must not touch each other.

These strips 171 and carrier members 173 are advantageously provided with an electrically conductive layer.

The strips advantageously have a height h of 5 to 10 mm and are advantageously separated from one another by a distance of between 5 and 10 mm.

Figure 11:
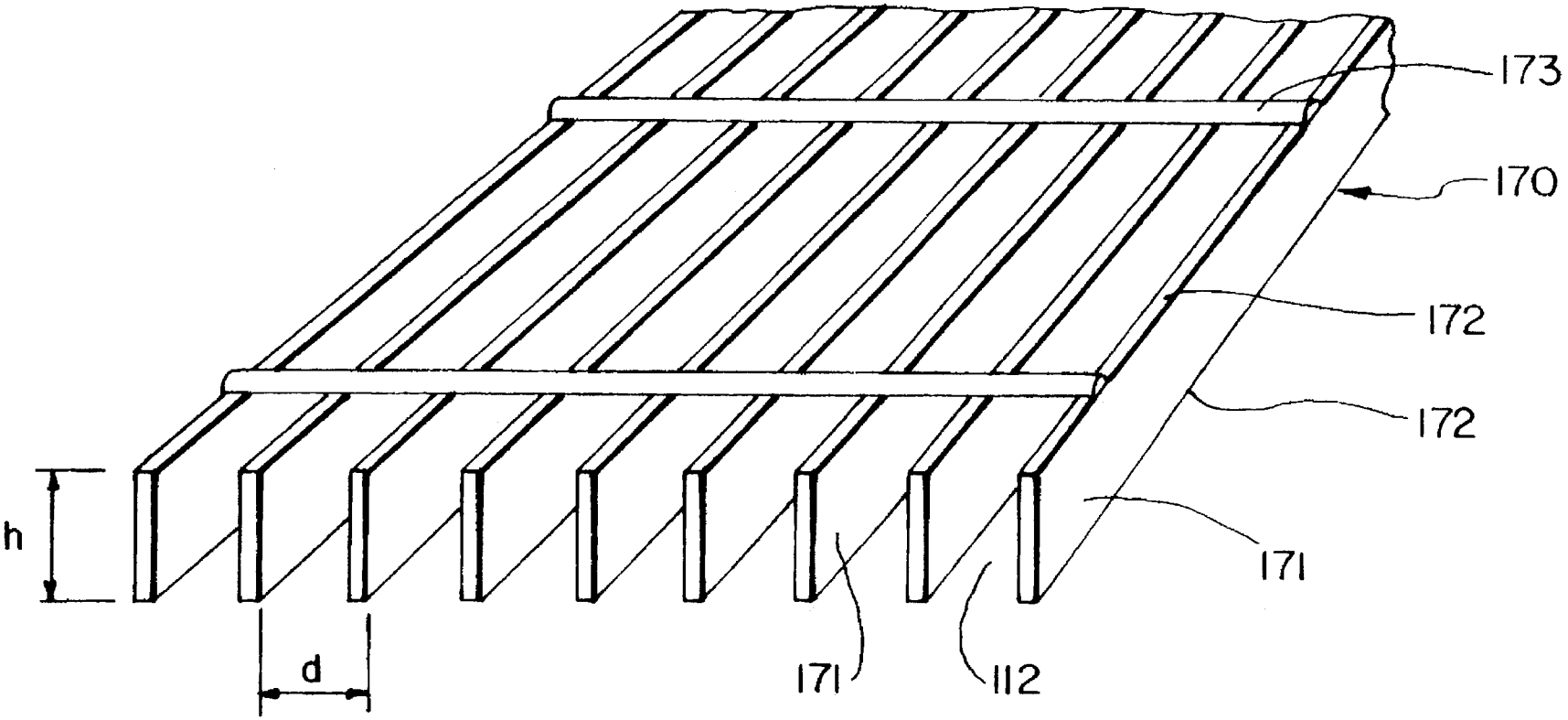
FIG. 11 shows, in perspective and on a larger scale, a part of the strips of the electrode shown in FIG. 8.

The strips, therefore, form between them a series of vertical channels 11 intended to direct the electrolyte in the vicinity of the electrode and in particular to ensure a minimum upward velocity of the electrolyte in relation to the electrode (see FIG. 11).

The strips 171 or preferably the carrier members 73 are welded to the head 157 to ensure an electrical contact between the electrode and the conductor bolt 162. It is obvious that other methods of securing the strips in relation to the head 157 permitting an electrical contact are possible.

The strips or fins 171 of an electrode extend in the vertical direction from the level N of the channels 154 adjacent to the lower edge 152 of the plate 149 up to the level M of the channels 154 adjacent to the upper edge 153 of the plate 149. The length l of the strips corresponds substantially to the width L of the insulating layer 167.

A protective insulating porous web 88 which is covered with a membrane 83 extends above the lengthwise edges 172 of the strips, edges which are opposite the lengthwise edges facing towards the head 157. This membrane 83 is, for example, an anionic or cationic membrane when the electrode is employed for depositing a metal or a metal alloy on a strip, but is preferably an anionic membrane when the electrode is employed for removing a deposit of a metal or of a metal alloy from a strip.

This web 88 and this membrane 83 are stretched between the protuberances 151 so as to form a chamber 78 in which the electrode lies. A secondary electrolyte e2 can pass through the said chamber 78, this electrolyte e2 being advantageously different from the primary electrolyte e1 adjacent to the strip 3 to be coated or to be treated in order to remove a layer of metal or metal alloy therefrom.

The free edges of the web 88 and of the membrane 83 are applied against a face 174 of the protuberance 151, a face advantageously forming the outer side face of the protuberance 151 of the plate 149.

Along their edges, the membrane 83 and the web are pressed against, on the one hand, a frame 175 of L-shaped cross-section and, on the other hand, the protuberance 151 and a seal 176 fitted in a groove with which the protuberance 151, is provided. To hold the frame 175 against the protuberance 151 U-shaped clamping sections 177 are employed.

One arm 178 of the section bears on the face of the protuberance 151 which faces the support 81, while the other arm 179 of the section bears against the frame 175, with the result that the latter 175; the web 88 and the membrane 83 are clamped between the protuberance 151 and the arm 179.

Four sections 177 are advantageously employed per plate 149, so as to clamp and to secure the web 88 and the membrane 83 substantially all along the protuberance 151 of the plate 149. In a particular embodiment, the sections 177 have miter-shaped ends so that these four sections of a plate form substantially a continuous frame extending along the protuberance 151 of the plate 149. The dish 145 of the cross member 144 of the frame 136 makes it possible to lay down the clamping sections 177, in the case of the protuberances 151 adjacent to the said cross member. In the case of these protuberances, the arm 178 extends between the face of the protuberance facing towards the support 81 and the bottom of the dish. A seal 180 made of synthetic material is inserted between the clamping sections 177 so as to prevent the primary electrolyte e1 from reentering the dish 145, but above all so as to form a beading 181 extending beyond the vertical plane in which the membranes 83 lie and the vertical plane in which the arms 179 of the sections 177 lie. Such a beading makes it possible to reduce, or even to completely avoid, any risk of contact of the strip to be treated with a membrane. This makes it possible to increase the lifetime of a membrane.

The system for securing the membrane which is shown (sections 177) permits a rapid fitting or replacement of the membrane and also permits, if need be, easy maintenance of the electrode.

It is obvious that other systems for securing the membrane could have been employed.

The circuit for the secondary electrolyte e2 in the electrode shown in FIG. 6 will be described below:

The electrolyte e2 enters through the opening 100 and is delivered by the conduit 130 in the vicinity of the bottom of the electrode (arrow E). The electrolyte e2 then passes through the channels 141 and 154 into the chamber 78 in which it flows vertically, from the bottom upwards, between the strips 171 of the electrode.

The electrolyte leaves this chamber 78 through the channels 154 and 141 which are adjacent to the upper edge 153 of the plate 149, to be delivered, via the channel 146 pierced in the cross member 144 and the channels 154 and 141 which are adjacent to the lower edge of the plate 149 shutting off the window 137, into the chamber 79. The electrolyte then moves into the passages formed between the strips 171 of the electrode in order finally to emerge from the chamber 79 via the channels 154 and 142 which are adjacent to the upper edge 153 of the plate 149. This electrolyte is finally discharged from the electrode via the conduit 132.

Figure 12:
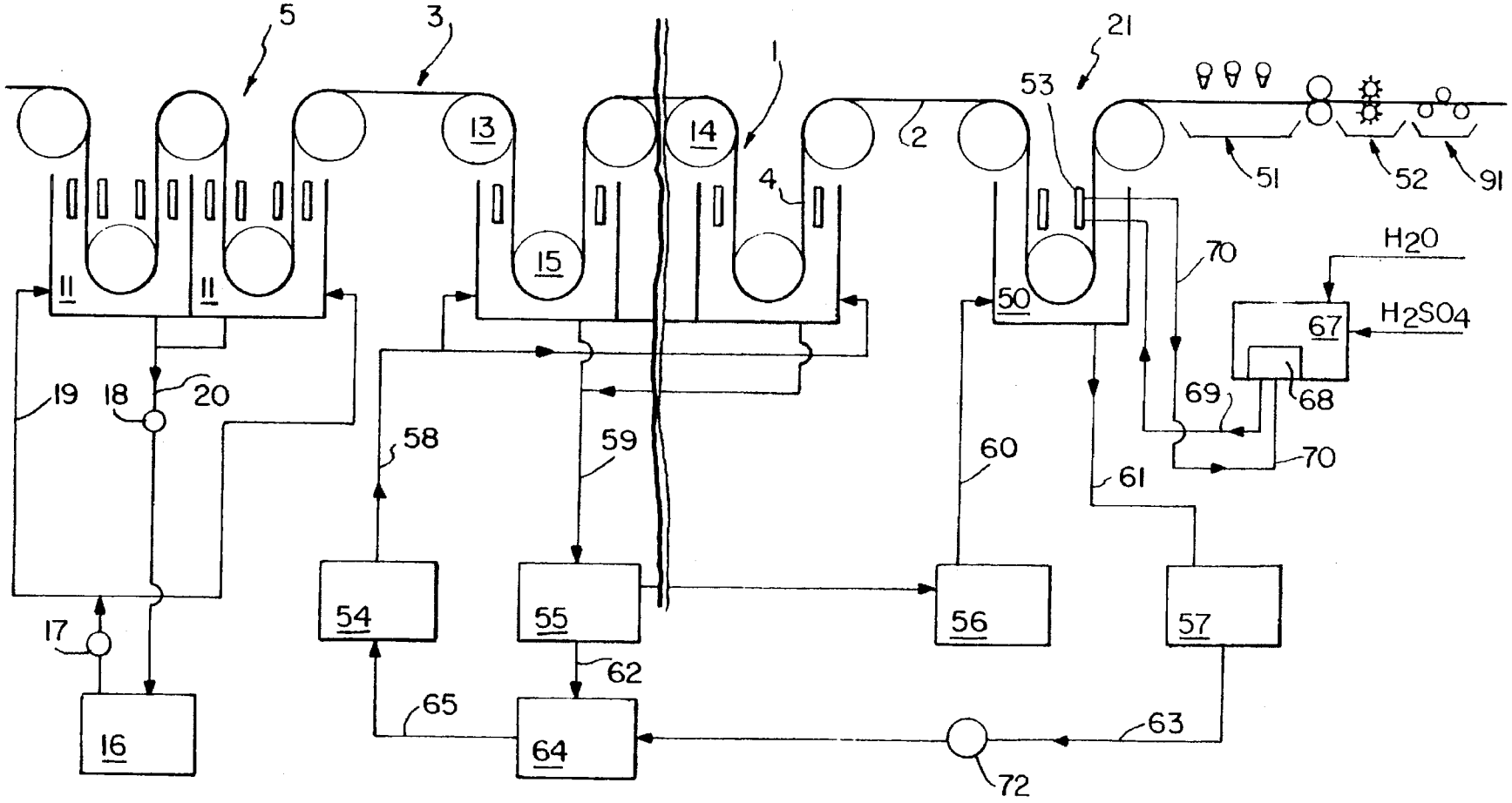
FIG. 12 is a diagrammatic view of a plant employing electrodes in accordance with the invention.

FIG. 12 shows diagrammatically a plant employing electrodes in accordance with the invention.

This plant comprises:

a series of electrolysis cells 1 for depositing an Ni—Zn layer on the face 2 of a steel strip 3; these cells contain anodes in accordance with the invention;

means 5 for providing the faces 2, 4 of the steel strip with a first layer of Zn before the steel strip is introduced into or immersed in the cells 1, so as to make it possible to remove chemically or electrochemically the Ni deposited on the first Zn layer of the face 4, and a plant 21 for removing the nickel deposited on the first Zn layer of the face 4, and for at least partially removing the said first layer.

The electrolysis cells 1 for the deposition of a Zn—Ni layer are, for example, of the type described in DE-A-3510592, but comprising anodes in accordance with the invention.

These cells 1 are connected to a storage vessel 54 by means of pumps, of a feed conduit 58 and of a discharge conduit 59 so as to ensure a substantially constant concentration of Ni and Zn in the electrolyte. The Ni and Zn concentration of the electrolyte is, for example, that given in BE-A-881635 and BE-A-882525. The electrolyte may also contain additives such as polymers, $ZrSO_4$, etc.

The storage vessel 54 is connected to a device for enriching the electrolyte in Zn and/or in Ni, so as to keep the Zn and Ni concentration of the electrolyte at a substantially constant value.

The means 5 for providing the faces 2, 4 of the steel strip 3 with a first Zn layer preferably comprise electrolytic cells 11 into which the steel strip 3 is introduced. These cells are also advantageously of the type described in DE-A-3510592, but comprising anodes in accordance with the invention.

The steel strip travels in the plant while bearing on the rollers 13, 14 and on the return rollers 15.

The cells 11 contain an electrolyte (a solution of $ZnSO_4$) and are connected to a storage vessel 16 by means of pumps 17, 18, of a feed conduit 19 and of a discharge conduit 20 for ensuring a more or less constant Zn concentration in the electrolyte. This storage vessel is connected to a reactor (not shown) for enriching the electrolyte in Zn.

The plant 21 for removing the Ni which may be deposited on the Zn layer and for at least partially removing the said Zn layer consists, in the embodiment shown, of a deplating cell 50 advantageously comprising a cathode in accordance with the invention.

After this deplating operation (removal of a metal layer), the strip 3 is subjected to a rinsing by virtue of the rinsing device 51, to a brushing in a brushing plant 52 to ensure that all the Ni deposited on the first Zn layer of the face 4 has been removed, and advantageously to a polishing in the unit 91.

The plant advantageously additionally comprises a series of storage vessels 54, 55, 56, 57. The first storage vessel 54 contains the electrolyte intended to be delivered to the cells I via conduits 58 fitted with pumps, while the second storage vessel 55 is intended to collect the electrolyte leaving the electrolytic cells 1 via conduits 59. The third storage vessel 56 contains the electrolyte intended to be delivered to the "deplating" cell 50 via the conduit 60, while the fourth storage vessel 57 is intended to collect the electrolyte leaving the "deplating" cell 50 via the conduit 61. A filter 72 is fitted in the conduit 63 to recover the Ni in the form of powder which has been removed from the steel strip. This Ni powder must be taken out of the electrolyte because it is in a form which is difficult to dissolve.

A proportion of the electrolyte from the second storage vessel 55 and the electrolyte from the fourth storage vessel 57 are conveyed via conduits 62, 63 towards a plant 64 for regenerating or enriching the electrolyte, the enriched electrolyte being next conveyed via a conduit 65 towards the storage vessel 54 intended for feeding the cells 1.

Another part of the electrolyte from the second storage vessel 55 is conveyed via a conduit 66 towards the storage vessel 56 intended to feed the "deplating" cell 50.

The plant additionally comprises a unit for storing and/or preparing 67 secondary electrolyte; this electrolyte, lean in Zn and Ni, being conveyed into the enclosure in which the cathode 53 is placed. This unit 67 comprises a storage tank 68 connected by a conduit 69 intended to deliver electrolyte into the enclosure 53 and by a conduit 70 intended to remove the electrolyte out of the enclosure and to return it into the tank 68. Water and sulphuric acid are delivered to this unit to compensate for the losses of $H_2O$ and $H_2SO_4$ ($SO_4^-$) in the electrode chambers.

Electrolyte which is lean in Zn and Ni could optionally be conveyed into the storage vessel 56 by a conduit.

In this plant, the steel strip has been provided with a first Zn layer with a thickness of 1 micron. To obtain such a layer on the faces 2, 4 of the strip, the strip was immersed in an electrolytic cell 11 in which the electrolyte contained 60 g/l of Zn. The current density between the cathode (the steel strip) and the anode 26 was 100 A/dm$^2$. The relative velocity of the strip in relation to the electrolyte was 1.5 m/s.

Once the strip had been provided with the Zn layer, the strip was delivered into electrolytic cells 1 in order to deposit a layer of Zn—Ni on the face 2 of the strip.

In a particular embodiment of the plant shown in FIG. 12, a fine layer of Zn—Ni was deposited in the cells 11 on the two faces of the steel strip 3. The thickness of the said layer was 0.5μ (weight per unit area: ±3.5 g/m$^2$), while the Ni content of the said layer was of the order of 10%. To perform this deposition, the electrolyte employed was the electrolyte employed in the cells 1.

The electrolyte which was employed in the cells 1 contained 25 g/l $Zn^{++}$, 50 g/l $Ni^{++}$ and 75 g/l $Na_2SO_4$. The pH of this electrolyte was 1.65 at 57.5° C. The anode-steel strip distance was approximately 15 mm.

The primary electrolyte employed in the "deplating" cell in the tests which were performed had the same composition as the electrolyte in the cells 1. However, it would have been possible to employ an electrolyte containing less $Zn^{++}$ and $Ni^{+}$.

The secondary electrolyte conveyed into the enclosure contained 75 g/l $Na_2SO_4$ (pH of approximately 1.7).

The cathode-strip distance in the "deplating" cell was 16 mm. The velocity of the secondary electrolyte in the enclosure was 0.4 m/s, while the velocity of the primary electrolyte was 1.5 m/s.

Tests were performed with the "deplating" cell to remove a layer of Zn or of Zn—Ni deposited electrolytically.

In these tests, the enclosure of the cathode had an anionic membrane of 150μ thickness, sold by Morgane (France), while the current density in the "deplating" cell varied between 0 and 50 A/dm$^2$.

When the current density was nil, no removal of Ni was observed. Next, the current density was increased, and an increasingly complete removal of Ni and of Zn was observed, as shown in the following table.

TABLE

| Weight per unit area before passing through the "deplating" cell | | Current density in | Zn + Ni/Fe or |
|---|---|---|---|
| g/m$^2$ Zn + Ni deposit | flash Zn deposit | the "deplating" cell A/dm$^2$ | Zn/Fe ratio of the face after brushing |
| 3 | | 0 | 30–42 |
| 3 | | 15 | 16–17 |
| 3 | | 20 | 0–8 |
| 3 | | 25 | 0–5 |
| 3 | | 50 | 0–4 |
| | 3 | 20 | 0 |

The time of travel of the strip in front of the cathodes was 4 seconds. It is obvious that by employing a longer time of travel it is possible, while employing a density of 20–25 A/dm$^2$, to obtain an Ni+Zn/Fe ratio close to 0 or equal to zero.

The plant shown, which makes it possible partially or completely to remove the Ni deposited on a Zn layer is a plant which makes it possible to reduce the losses of electrolyte as much as possible by virtue of recirculation system. This also makes it possible to reduce the total usage of Zn and Ni in the plant and to reduce the operating and capital costs of plants for purifying discharges.

It is obvious that the rinsing device can be equipped with a unit (not shown) for recovering electrolyte, Zn and Ni.

So as to reduce the losses of electrolyte further and to simplify the plant operation, a thin 0.5μ) layer of Zn—Ni is advantageously deposited in the cells 11. To perform such a deposition, the electrolyte employed is advantageously the same as that employed in the cells 1. In this case, the same single electrolyte can be employed in the cells 1, 11 and the "deplating" cells (cells for removing Ni and/or Zn and/or a Zn alloy).

Similarly, to reduce the number of electrodes of different type employed in the plant, an electrode with a membrane is employed both in the "deplating" cells and in the cells for depositing a layer of Zn or of a Zn alloy.

In the case of "deplating" cells, the current density is advantageously lower than 60 A/dm$^2$. However, in the case of cells for depositing a layer of Zn, Zn—Ni or other Zn alloy, this density may be higher than 60 A/dm$^2$, for example 100 A/dm$^2$.

Figure 13:
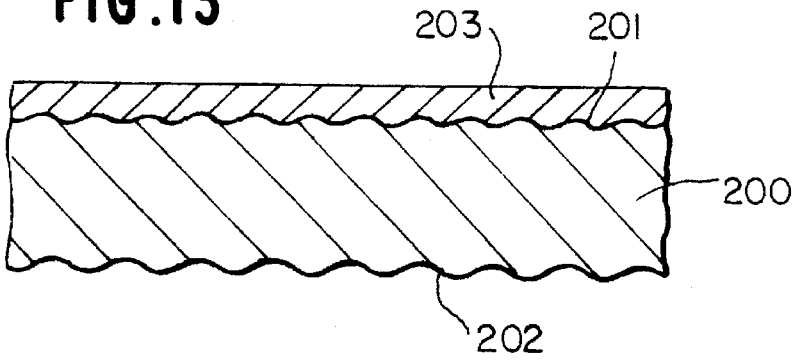
FIGS. 13 and 14 show, in section and on a larger scale, a steel strip which has been obtained by employing electrodes in accordance with the invention.
Figure 14:
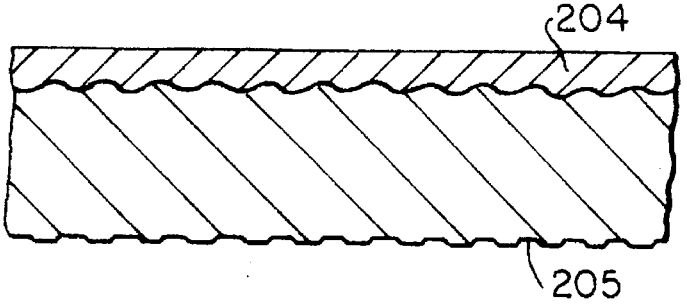

Finally, FIGS. 13 and 14 show in section and on a larger scale, respectively, a steel strip which has been obtained in a plant of the type shown in FIG. 12 and a steel strip one face of which has been subjected to an overpickling or a polishing.

The steel strip 200 according to the invention is provided with an Ni—Zn layer on one face. On the other face of the strip the remaining Zn concentration is lower than 50 μg/m$^2$ (in particular than 10 μg/m$^2$). This Zn remaining on this face is distributed uniformly and homogeneously.

Such a distribution, combined with the presence of a very small quantity of Zn and Ni (advantageously less than 25 μg/m$^2$ and preferably less than 10 μg/m$^2$) makes it possible to obtain good phosphating.

A strip in accordance with the invention is, therefore, a strip which has one face covered with a layer of Zn—Ni and whose other face is provided with Zn and/or Ni which are distributed uniformly and/or homogeneously where the weight of Zn and/or Ni per unit area of the said other face is greater than 0.1 μg/m$^2$ but smaller than 25, preferably than 10 μg/m$^2$. A weight per unit area of 0.1 μg/m$^2$ is a weight per unit area demonstrating the absence of an overpickling and therefore of the attack on a face of the steel strip.

A strip which it is possible to obtain by a process in accordance with the invention has a face not covered with Zn and Ni, and has a roughness which is substantially equal to that which the steel strip had before its treatment (deposition of a Zn—Ni layer).

Thus, it is possible to obtain a steel strip 200 which has an upper face 201 and an upper face 202 of substantially equal roughness, one (201) of the said faces being covered with a layer of Zn—Ni 203.

When the strip has been subjected to an overpickling or to a polishing, the face 205 not covered with the Zn—Ni layer has undergone an attack modifying the roughness of the steel strip. Moreover, an overpickling will cause a decrease in the thickness of the Zn—Ni layer 204, while during a polishing operation scratches will be formed in the steel strip.

The steel strip in accordance with the invention can next be subjected to a phosphating and be covered with one or more layers of paint on the face 105 which is not covered with the Zn—Ni layer. It has been noted that it is possible to obtain a better adherence of the layers of paint or at least an adherence equivalent to that of a steel strip not provided with a Zn—Ni layer.

To coat a strip electrochemically with a layer of a metal, it is possible to employ an electrode with both an anionic membrane and a cationic membrane. However, since an electrode with an anionic membrane is preferably employed for removing a layer of a metal, it may be advantageous to employ the same electrodes with an anionic membrane both for the electrolytic deposition and for the electrolytic removal of a metal layer, so as to make it possible to employ an electrode once for the electrolytic deposition and once for the electrolytic removal of a layer.

Figure 15:
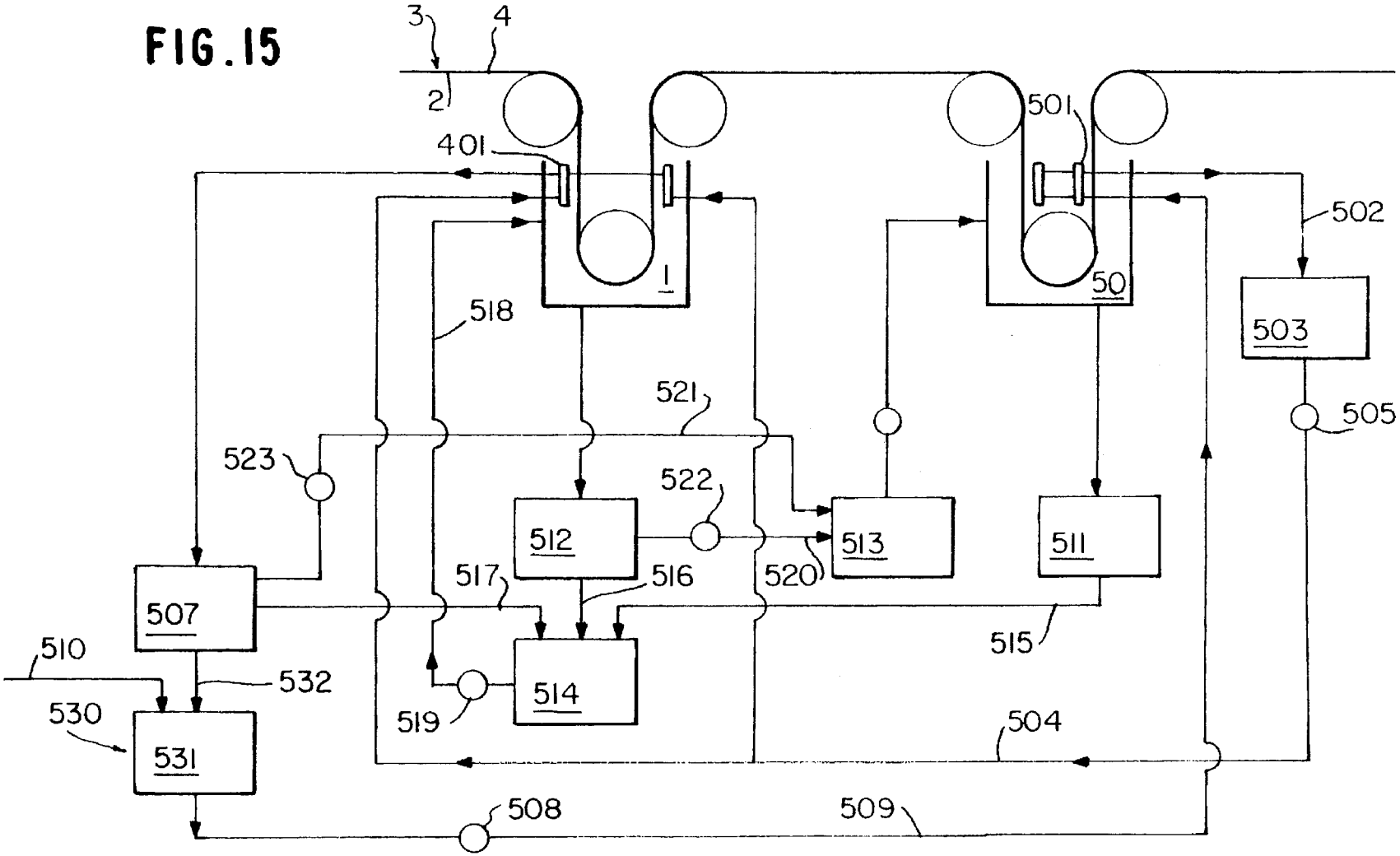
FIGS. 15 to 18 show particular embodiments of plant employing electrodes in accordance with the invention.

FIG. 15 shows, diagrammatically, a plant comprising, on the one hand, a cell 1 for depositing a Zn—Ni layer on the face 2 of a galvanized strip 3 and, on the other hand, a cell 50 for removing the galvanized layer from the face 4 of the strip 3. In this plant, the electrodes employed are electrodes in accordance with the invention, provided with anionic membranes.

The electrolyte which leaves the electrode chamber 501 of the cell 50 is depleted in $SO_4^=$. This electrolyte is delivered by the conduit 502 into the tank 503. Electrolyte leaving this tank 503 is conveyed via the conduit 504 and the pump 505 into the anode chamber 401 of the cell 1. When it passes through the anode chamber, the electrolyte becomes enriched in $H_2SO_4$. This enriched electrolyte is delivered by the conduit 506 into a tank 507.

The tanks 503 and 507 are advantageously used in combination with a unit 530 for compensating the losses of water and/or $SO_4^=$ of the secondary circuit of electrolyte in the electrodes. Such a unit comprises a mixing tank 531 for electrolyte originating from the conduit 532 from the tank 507 and water and/or $H_2SO_4$ originating from a conduit 510.

In this case, the case shown in FIG. 14, the electrolyte from the tank 531 is delivered into the cathode chamber 501 by the conduit 508 in which the pump 509 is fitted.

The plant additionally comprises, a storage vessel 511 for collecting the electrolyte leaving the cell 50;

a storage vessel 512 for collecting the electrolyte leaving the cell 1, an electrolyte lean in Zn—Ni;

a storage vessel 513 for feeding the cell 50 with an electrolyte lean in Zn—Ni, and a storage vessel 514 for feeding the cell 1 with an electrolyte rich in Zn—Ni.

The storage vessel 514 receives via the conduits 515 and 516 electrolyte from the storage vessels 511 and 512 and optionally via the conduit 517 electrolyte originating from the tank 507. This conduit 517 optionally makes it possible to purge the secondary circuit. The enrichment of the electrolyte in the storage tank 514 is carried out by adding Zn—Ni metal powders and optionally $H_2SO_4$ acid.

The enriched electrolyte is conveyed into the cell 1 by the conduit 518 and the pump 519.

The storage vessel 513 which feeds the cell 50 with electrolyte lean in Zn—Ni is fed with the electrolyte originating from the storage vessel 512 and advantageously from the storage vessel 507 (conduit 520, pump 22 and conduit 521, pump 523).

Such a plant makes it possible to reduce considerably the losses of Zn—Ni and permits a better utilization of the electrolytes.

Figure 16:
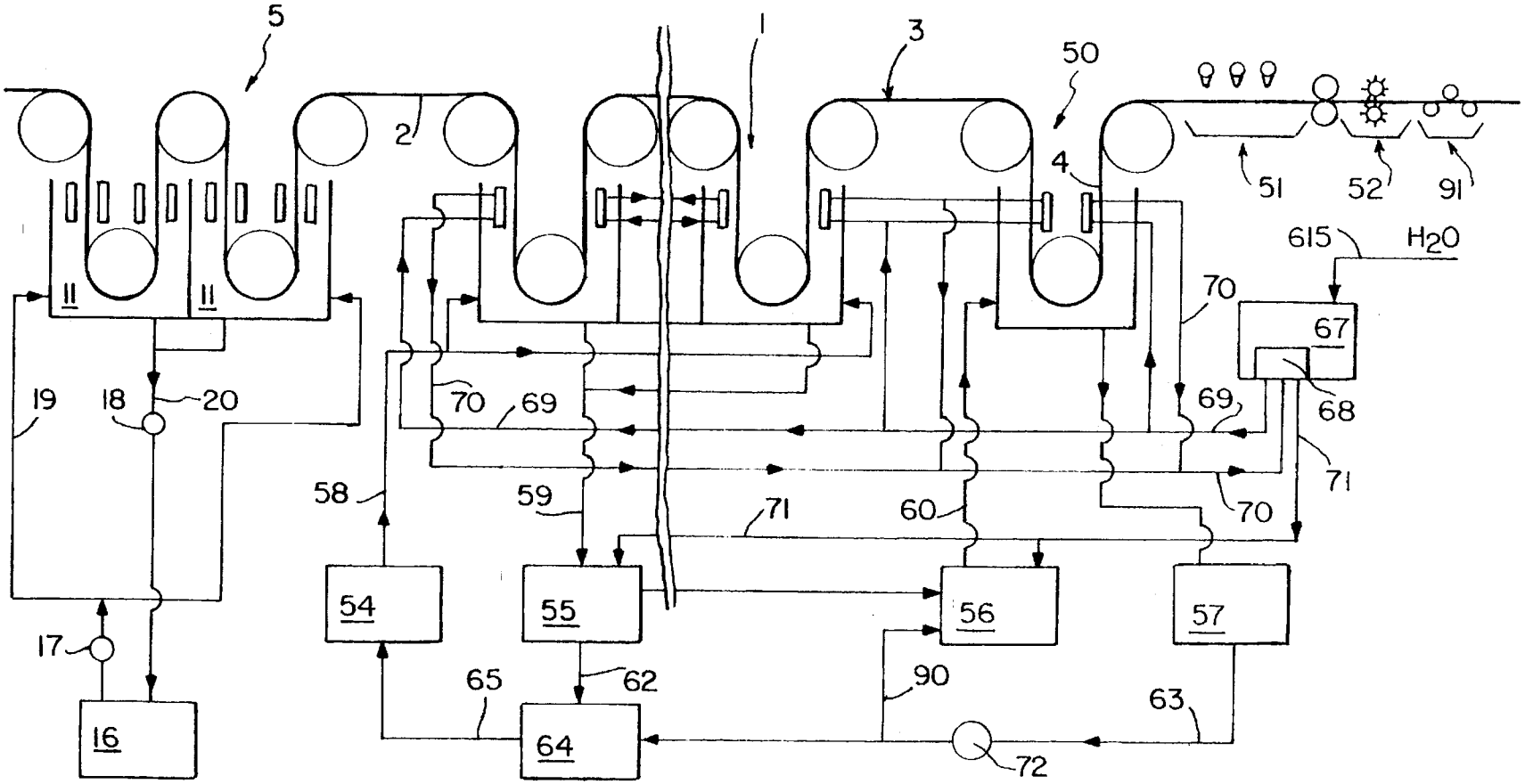
Figure 17:
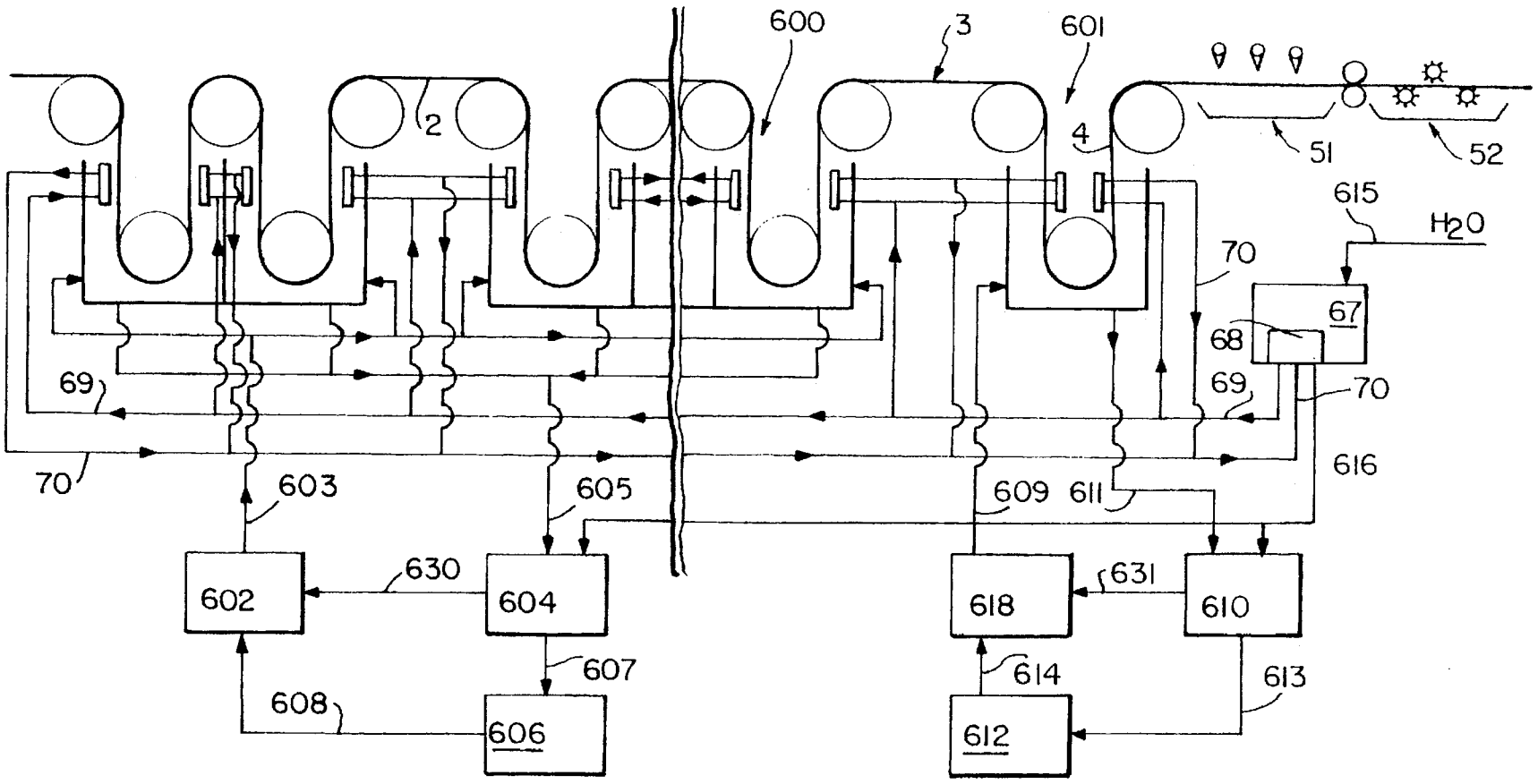
Figure 18:
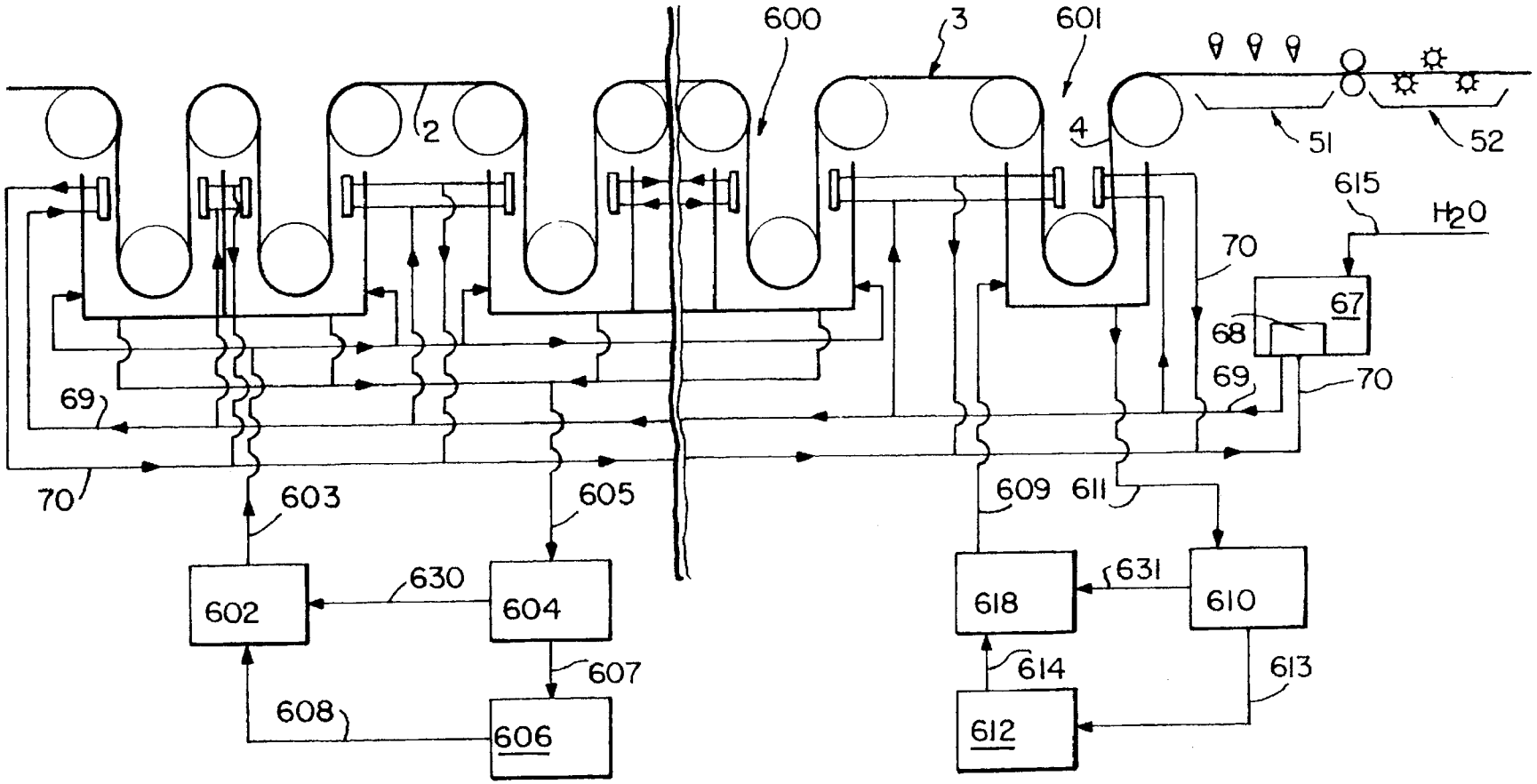

Finally, FIGS. 16 to 18 show, diagrammatically, embodiments of a plant similar to that shown in FIG. 2.

In the form shown in FIG. 16, electrodes provided with an anionic membrane are employed as anode in the cells 1 for the electrolytic deposition of Zn or Zn—Ni on the face 2 of the strip 3 and as cathode in the cells 50 for removing a layer of Fe—Zn, Zn or Zn—Ni optionally coated with Ni or Ni—Zn, a layer present on the face 4 of the strip 3.

The secondary electrolyte conveyed into the electrodes originates from the tank 68 of a unit for preparing electrolyte, which is fed with water to obtain a correct dosage of the secondary electrolyte.

Secondary electrolyte may be conveyed via the conduit 71 towards the storage vessels 55 and 56 which are intended to collect the primary electrolyte originating from the cells 1 and 50 respectively.

A proportion of the electrolyte originating from the tank 57, after filtration (filter 72), is returned to the tank 56 feeding the cell 50 (conduit 90).

The other members, conduits and components of the plant shown in FIG. 16 are similar to the members, conduits or components of the plant shown in FIG. 12. These same members, conduits and components are indicated by the same reference numbers.

In this embodiment, it is possible, at the same time, to ensure a material balance equilibrium of the cells 1 (electrolytic deposition) and of the cell 50 (electrolytic removal) by virtue of the transfer of electrolyte from the tank 57 towards the tank 56 by the conduit 90, advantageously after filtration (filter 72).

The plants shown in FIGS. 17 and 18 relate to plants for the deposition of a first layer of Zn, ZnNi or other Fe alloys and of a second layer of Fe, Zn—Fe or iron alloy.

These plants permit, inter alia, the deposition of Zn or Zn—Ni on one face 2 of the strip 3 and the deposition of Fe or Fe—Zn or other Fe alloy on the face 4 of the strip 3; this face 4 being opposite the face 2. The deposit of Fe or other Fe alloy (Fe—Zn) is intended to cover the Zn or Zn—Ni which would have been deposited on the face 4. This deposit of Fe or Fe alloy permits a phosphating of the face 4 as well as good adherence of a layer of paint.

The plant in FIG. 17 comprises cells 600 and 601 with anodes which have an anionic membrane according to the invention. These are intended for the deposition of a layer of metal on the face 2 of the strip 3. It is obvious that the cells could have included anodes arranged on both sides of the strip so as to provide both sides of the strip with a layer of metal.

The plant comprises:

a storage vessel 602 for feeding the cells 600 via the conduit 603 with electrolyte rich in Zn, Zn—Ni or other alloy;

a storage vessel 604 for collecting the depleted electrolyte leaving the cells 600 via the conduit 605;

a unit 606 for enriching the electrolyte originating from the conduit 607 of the storage vessel 604, this enriched electrolyte being conveyed by the conduit 608 towards the storage vessel 602;

a storage vessel 618 for feeding the cell 601 via the conduit 609 with electrolyte rich in Zn Fe, or other alloy;

a storage vessel 610 for receiving the depleted electrolyte leaving the cell 601 via the conduit 611;

a unit 612 for enriching the electrolyte originating from the conduit 613 of the storage vessel 610; this enriched electrolyte being returned via the conduit 614 into the storage vessel 618, and a unit for storing and preparing 67 electrolyte intended to circulate in the anode chambers.

This unit 67 comprises a tank 68 connected by conduits 69 and 70 to the anodes to deliver secondary electrolyte and for returning the secondary electrolyte to the tank 68 after it has passed through the anodes.

This unit 67 comprises a water delivery 615 for compensating the losses of water from the electrolyte or the increase in its $H_2SO_4$ content. The surplus of $H_2SO_4$ in the electrolyte, due to the latter's passage through the anodes is advantageously conveyed via the conduit 616 into the storage vessels 604 and 610 to receive the depleted primary electrolytes leaving the cells 600 and 601.

Advantageously, only a proportion of the electrolyte from the tanks 604 and 610 is conveyed towards the enrichment units 606 and 612. In this case, conduits 630 and 631 allow electrolyte to be conveyed directly from the tanks 604, 610 towards the storage vessels 602 and 618.

FIG. 18 shows a plant similar to that shown in FIG. 16, except that the cells 600, 601 included anodes provided with a cationic membrane, and consequently, the secondary electrolyte is not conveyed into the storage vessels 604 and 610 after passing through the anode chambers.

In FIGS. 17 and 18, the same reference signs denote identical members.

The storage vessels for feeding the cells with electrolyte rich in, for example, Zn, Ni, the storage vessels for receiving the depleted electrolyte leaving the cells and the units for enriching the electrolyte are advantageously of the type described in application EP-A-0388386.

As can be seen from FIGS. 15 to 18, the chamber of an electrode of a first cell (1, 600) and the chamber of an electrode of a second cell (50, 601) are mounted in one and the same circuit.

In an embodiment, particularly when the membranes employed are anionic, the electrolyte circuit is such that electrolyte leaving the chamber of an electrode of a first cell (1) is conveyed, optionally after treatment (addition of water, $H_2SO_4$, etc.) into the chamber of an electrode of a second cell (50) and electrolyte leaving the chamber of an electrode of a second cell is conveyed into the chamber of an electrode of the first cell, optionally after treatment (addition of water, etc.).

We claim:

1. Process for the electrochemical plating of a metal strip with a metal in a cell provided with an insoluble anode and in which the metal strip acts as a cathode, in which a first electrolyte containing a salt of a plating metal is recycled between a cathodic metal strip to be plated and an insoluble anode, in which the insoluble anode is an electrode, wherein said electrode comprises a set of vertical fins having a bottom and a top, said set of fins being located within an enclosure defining a chamber, wherein a vertical wall of said enclosure is formed by a membrane allowing ions to pass therethrough, said enclosure having a feeding passage for feeding a second electrolyte into the chamber at the bottom of the set of fins and an outlet passage for evacuating electrolyte from the chamber at the top of the set of fins creating an upward current of electrolyte in the chamber, in which the set of fins acts as an electrode and defines therebetween separate channels for conducting the upward current of electrolyte in the chamber, a wall of said channels being formed by a porous web bearing the membrane allowing ions to pass therethrough, wherein the fins have a height between 5 and 10 mm, and the distance separating two adjacent fins is between 5 and 10 mm to ensure a velocity of the electrolyte adjacent to the fins of at least 0.01 m/s, wherein the membrane is arranged between the anode and the metal strip to be plated so that said membrane separates the cell into a cathodic space adjacent to the metal strip and an anodic space defined by the chamber of the enclosure and forms a separation between the cathodic space of the cell and the chamber defined by the enclosure of the electrode, wherein in said process a first circuit of the first electrolyte in the cathodic space and a second circuit of the second electrolyte in the chamber are created, the membrane preventing the passage of gases formed at the anode into the first circuit of the first electrolyte and the passage of the salt of the plating metal from the cathodic space into the second circuit of the second electrolyte in the chamber.

2. Process for the electrochemical plating of a metal strip according to claim 1 with iron compounds, in which the first electrolyte is a sulfuric electrolyte enriched in iron and zinc sulfate and in which the second electrolyte is devoid of metal and consists of water and sulfuric acid, wherein an anion exchange membrane is arranged between the anode and the metal strip to be plated, the membrane allowing the transfer of charge only by the transfer of $SO_4^=$ ions into the anode chamber and preventing the passage of the metal salts, so that the second electrolyte devoid of metal is supplementary enriched in sulfuric acid, and the oxygen formed at the insoluble anode is discharged from the anode chamber and the passage of oxygen into the cathodic space is prevented by means of the anion exchange membrane.

3. Process according to claim 2 in which the part of electrolyte in excess which is formed, the nature of which is similar to that of the anode chamber, is conveyed to the cathodic electrolyte circuit through a dissolving station.

4. Process for the electrochemical plating of a metal strip according to claim 1 with iron compounds, in which the first electrolyte is a chloride electrolyte enriched in iron and zinc chloride, and in which the second electrolyte is devoid of metal and consists of water and chlorhydric acid, in which an anion exchange membrane is arranged between the anode and the metal strip to be plated, wherein the membrane allows the passage of chlorine in the anode chamber but prevents the passage of the metals salts, so that the second electrolyte is not enriched in metal salts, and the chloride transformed into the second electrolyte flow devoid of metal of the anode chamber is removed and the passage of chlorine in the cathodic space is prevented by the anion exchange membrane.

5. Process for the electrochemical plating of a metal strip according to claim 1 with iron compounds, in which the first electrolyte is a sulfuric electrolyte enriched in iron and zinc sulfate and in which the second electrolyte is devoid of metal and consists of water and sulfuric acid, in which a cation exchange membrane is arranged between the anode and the metal strip to be plated, wherein the membrane prevents the transfer of acids from the cathodic space into the anode chamber and allows the transfer of charge by the transfer of hydrogen ions from the anode chamber into the cathodic space, and the oxygen formed at the anode is removed from the second electrolyte devoid of metal of the anode chamber and the passage of oxygen in the cathodic space is prevented by the cation exchange membrane.

6. Process according to claim 5, in which the part of electrolyte in excess which is formed, the nature of which is similar to that of the anode chamber, is conveyed to the cathodic electrolyte circuit through a dissolving station.

7. Process for the electrochemical plating of a metal strip according to claim 1 with iron compounds, in which the first electrolyte is a chloride electrolyte enriched in iron and zinc chloride and in which the second electrolyte is devoid of metal and consists of water and chlorhydric acid, in which a cation exchange membrane is arranged between the anode and the metal strip to be plated, wherein the membrane prevents the passage of acids and salts from the cathodic space into the anode chamber and allows the transfer of charge by the transfer of hydrogen ions from the anode chamber into the cathodic space, and the gases formed at the anode are removed from the anode chamber with the second electrolyte devoid of iron containing chlorhydric acid and the passage of gases formed in the cathodic space is prevented by the cation exchange membrane.

8. Process according to claim 1 for plating a metal strip with iron compound, wherein to replace the iron deposited on the metal strip, an amount of elemental iron corresponding to the deposited amount is added to the first electrolyte which flows through the cathodic space.

9. Vertically oriented electrode for electrolytic cell, said electrode comprising a set of vertical fins having a bottom and a top, said set of fins being located within an enclosure defining a chamber, wherein a vertical wall of said enclosure is formed by a membrane allowing ions to pass therethrough, said enclosure having a feeding passage for feeding an electrolyte into the chamber at the bottom of the set of fins and an outlet passage for evacuating electrolyte from the chamber at the top of the set of fins creating an upward current of electrolyte in the chamber, in which the set of fins acts as an electrode and defines therebetween separate channels for conducting the upward current of electrolyte in the chamber, a wall of said channels being formed by a porous web bearing the membrane allowing ions to pass therethrough, wherein the fins have a height between 5 and 10 mm, and the distance separating two adjacent fins is between 5 and 10 mm to ensure a velocity of the electrolyte adjacent to the fins of at least 0.01 m/s.

10. Electrode according to claim 9, in which the enclosure has a third opening at the top of the set of fins for discharging gases outside the chamber.

11. Electrode according to claim 9 in which the membrane is an anionic membrane.

12. Electrode according to claim 9 in which the membrane is provided with a protective layer.

13. Electrode according to claim 9 in which a porous support contacts the membrane and acts as supporting means for at least one part thereof.

14. Electrode according to claim 13, in which the support is selected from the group consisting of a perforated component, a porous web and a trellis.

15. Electrode according to claim 13, in which the support has a first face contacting the membrane and a second face opposite that adjacent to the membrane, wherein the second face is provided with a layer acting as an electrode.

16. Electrode according to claim 13, in which the membrane rests on a support acting as an electrode, said support is provided with an insulating layer on its face adjacent to the membrane.

17. A method of using an electrode comprising providing an electrode according to claim 1 in an electrolytic cell.

18. Electrode according to claim 9, in which the membrane is a cationic membrane.

19. Vertically oriented electrode for electrolytic cell, said electrode comprising:

(a) a first set of vertical fins having a bottom and a top, said first set of fins being located within a first enclosure defining a first chamber, wherein a vertical wall of said enclosure is formed by a membrane allowing ions to pass therethrough, said first enclosure having a feeding passage for feeding an electrolyte into the first chamber at the bottom of the first set of fins and an outlet passage for evacuating electrolyte from the chamber at the top of the first set of fins creating an upward current of electrolyte in the first chamber, in which the first set of fins acts as an electrode and defines therebetween separate channels for conducting the upward current of electrolyte in the chamber, a wall of said channels being formed by a porous web bearing the membrane allowing ions to pass therethrough, said porous web acting as an electrode, wherein the fins have a height between 5 and 10 mm and a distance separating two adjacent fins between 5 and 10 mm ensuring a velocity of the electrolyte adjacent to the fins of at least 0.1 m/s;

(b) a second set of vertical fins having a bottom and a top, said second set of fins being located within a second enclosure defining a second chamber, said second enclosure being above the first enclosure, wherein a vertical wall of said second enclosure is formed by a membrane allowing ions to pass therethrough, said second enclosure having a feeding passage for feeding an electrolyte into the second chamber at the bottom of the second set of fins and an outlet passage for evacuating electrolyte from the second chamber at the top of the second set of fins creating an upward current of electrolyte in the second chamber, in which the second set of fins acts as an electrode and defines therebetween separate channels for conducting the upward current of electrolyte in the second chamber, a wall of said channels being formed by a porous web bearing the membrane allowing ions to pass therethrough, said porous web acting as an electrode, wherein the fins have a height between 5 and 10 mm and a distance separating two adjacent fins between 5 and 10 mm ensuring a velocity of the electrolyte adjacent to the fins of at least 0.1 m/s;

(c) a cross member linking the first enclosure with the second enclosure, said cross member having passages extending between the outlet passage of the first enclosure and the feeding passage of the second enclosure, where electrolyte flowing out from the first chamber flows into the second chamber, and (d) a beading extending between the first enclosure and the second enclosure, said beading extending beyond the vertical walls of the first and second enclosures formed by a membrane.

20. Electrode according to claim 19, in which the second enclosure has a third opening above the top of the second set of fins for discharging gases outside the second chamber.

21. Process for the electrochemical plating of a metal strip with a metal in a cell provided with an insoluble anode and in which the metal strip acts as a cathode, in which a first electrolyte containing a salt of a plating metal is recycled between a cathodic metal strip to be plated and an insoluble anode, in which the insoluble anode is an electrode, wherein said electrode comprises:

(a) a first set of vertical fins having a bottom and a top, said first set of fins being located within a first enclosure defining a first chamber, wherein a vertical wall of said enclosure is formed by a membrane allowing ions to pass therethrough, said first enclosure having a feeding passage for feeding a second electrolyte into the first chamber at the bottom of the first set of fins and an outlet passage for evacuating second electrolyte from the chamber at the top of the first set of fins creating an upward current of second electrolyte in the first chamber, in which the first set of fins acts as an electrode and defines therebetween separate channels for conducting the upward current of second electrolyte in the chamber, a wall of the said channels being formed by a porous web bearing the membrane allowing ions to pass therethrough, said porous web acting as an electrode, wherein the fins have a height between 5 and 10 mm and a distance separating two adjacent fins between 5 and 10 mm ensuring a velocity of the second electrolyte adjacent to the fins of at least 0.1 m/s;

(b) a second set of vertical fins having a bottom and a top, said second set of fins being located within a second enclosure defining a second chamber, said second enclosure being above the first enclosure, wherein a vertical wall of said second enclosure is formed by a membrane allowing ions to pass therethrough, said second enclosure having a feeding passage for feeding an electrolyte into the second chamber at the bottom of the second set of fins and an outlet passage for evacuating electrolyte from the second chamber at the top of the second set of fins creating an upward current of electrolyte in the second chamber, in which the second set of fins acts as an electrode and defines therebetween separate channels for conducting the upward current of electrolyte in the second chamber, a wall of said channels being formed by a porous web bearing the membrane allowing ions to pass therethrough, said porous web acting as an electrode, wherein the fins have a height between 5 and 10 mm and a distance separating two adjacent fins between 5 and 10 mm ensuring a velocity of the electrolyte adjacent to the fins of at least 0.1 m/s;

(c) a cross member linking the first enclosure with the second enclosure, said cross member having passages extending between the outlet passage of the first enclosure and the feeding passage of the second enclosure, where the second electrolyte flowing out from the first chamber flows into the second chamber, and (d) a beading extending between the first enclosure and the second enclosure, said beading extending beyond the vertical walls of the first and second enclosures formed by a membrane, wherein the membrane is arranged between the anode and the metal strip to be plated so that said membrane separates the cell into a cathodic space adjacent to the metal strip and an anodic space defined by the chambers of the enclosures and forms a separation between the cathodic space of the cell and the chambers defined by the enclosures of the electrode, wherein in said process a first circuit of the first electrolyte in the cathodic space and a second circuit of the second electrolyte in the chambers are created, the membrane preventing the passage of gases formed at the anode into the first circuit of the first electrolyte and the passage of the salt of the plating metal from the cathodic space into the second circuit of the second electrolyte in the chambers.

22. Process for the electrochemical plating of a metal strip according to claim 21 with iron compounds, in which the first electrolyte is a sulfuric electrolyte enriched in iron and zinc sulfate and in which the second electrolyte is devoid of metal and consists of water and sulfuric acid, wherein an anion exchange membrane is arranged between the anode and the metal strip to be plated, the membrane allowing the transfer of charge only by the transfer of $SO_4^{-2}$ ions into the anodic space and preventing passage of metal salts, so that the second electrolyte devoid of metal is supplementally enriched in sulfuric acid, and oxygen formed at the insoluble anode is discharged from the anodic space and passage of oxygen into the cathodic space is prevented by means of the anion exchange membrane.

23. Process for the electrochemical plating of a metal strip according to claim 21 with iron compounds, in which the first electrolyte is a chloride electrolyte enriched in iron and zinc chloride, and in which the second electrolyte is devoid of metal and consists of water and chlorhydric acid, in which an anion exchange membrane is arranged between the anode and the metal strip to be plated, wherein the membrane allows passage of chlorine into the anodic space but prevents passage of metal salts, so that the second electrolyte is not enriched in metal salts, and chloride transformed into the second electrolyte flow devoid of metal in the anodic space is removed and passage of chlorine into the cathodic space is prevented by the anion exchange membrane.

24. Process for the electrochemical plating of a metal strip according to claim 21 with iron compounds, in which the first electrolyte is a sulfuric electrolyte enriched in iron and zinc sulfate and in which the second electrolyte is devoid of metal and consists of water and sulfuric acid, in which a cation exchange membrane is arranged between the anode and the metal strip to be plated, wherein the membrane prevents transfer of acids from the cathodic space into the anodic space and allows transfer of charge by transfer of hydrogen ions from the anodic space into the cathodic space, and oxygen formed at the anode is removed from the second electrolyte devoid of metal in the anodic space and the passage of oxygen into the cathodic space is prevented by the cation exchange membrane.

25. Process for the electrochemical plating of a metal strip according to claim 21 with iron compounds, in which the first electrolyte is a chloride electrolyte enriched in iron and zinc chloride and in which the second electrolyte is devoid of metal and consists of water and chlorhydric acid, in which a cation exchange membrane is arranged between the anode and the metal strip to be plated, wherein the membrane prevents passage of acids and salts from the cathodic space into the anodic space and allows transfer of charge by transfer of hydrogen ions from the anodic space into the cathodic space, and gases formed at the anode are removed from the anodic space with the second electrolyte devoid of iron containing chlorhydric acid and passage of gases formed in the cathodic space is prevented by the cation exchange membrane.

* * * * *